US006278234B1

(12) United States Patent
Ono et al.

(10) Patent No.: US 6,278,234 B1
(45) Date of Patent: Aug. 21, 2001

(54) IMAGE DISPLAY APPARATUS WITH GETTERING SUBSTANCE PROVIDED ELECTRICALLY CONNECTED TO WIRES

(75) Inventors: Takeo Ono, Sagamihara; Yasue Sato, Kawasaki, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/301,580

(22) Filed: Apr. 29, 1999

Related U.S. Application Data

(62) Division of application No. 08/571,380, filed on Dec. 13, 1995, now Pat. No. 5,936,342.

(30) Foreign Application Priority Data

Dec. 14, 1994 (JP) ..... 6-310524
Jul. 10, 1995 (JP) ..... 7-173622
Dec. 11, 1995 (JP) ..... 7-322021

(51) Int. Cl.[7] ..... H01J 1/62; H01J 63/04

(52) U.S. Cl. ..... 313/495; 313/497; 313/553; 313/555; 313/557; 313/558; 313/562

(58) Field of Search ..... 313/495, 558, 313/497, 553, 555, 557, 562

(56) References Cited

U.S. PATENT DOCUMENTS 4,563,613 * 1/1986 Genovese et al. ..... 313/495
5,936,342 * 8/1999 Ono et al. ..... 313/495

FOREIGN PATENT DOCUMENTS 0523702 1/1993 (EP) .
WO 94/20975 9/1994 (WO) .

* cited by examiner

*Primary Examiner*—Vip Patel
*Assistant Examiner*—Kevin Quarterman
(74) *Attorney, Agent, or Firm*—Fitzpatrick, Cella, Harper & Scinto

(57) ABSTRACT

An image-forming apparatus comprises an electron source and an image-forming member disposed in an envelope. The image-forming member includes a fluorescent film and a metal back covering the fluorescent film. The metal back contains a gettering substance and the gettering substance is irradiated with electron beams emitted from the electron source.

11 Claims, 17 Drawing Sheets

IMAGE DISPLAY APPARATUS WITH GETTERING SUBSTANCE PROVIDED ELECTRICALLY CONNECTED TO WIRES

This application is a division of application Ser. No. 08/571,380, filed Dec. 13, 1995 now U.S. Pat. No. 5,936, 342.

BACKGROUND OF THE INVENTION

1. Field of the Invention

This invention relates to an image-forming apparatus comprising an electron source and an image-forming member (fluorescent body) for forming an image by irradiation of electron beams emitted from the electron source as well as to a method of activating a getter in such an apparatus.

2. Related Background Art

In an image-forming apparatus comprising an electron source, a fluorescent body that operates as an image-forming member and fluoresces to form an image thereon when irradiated with electron beams emitted from the electron source and a vacuum container for containing the electron source and the image-forming member, the inside of the vacuum container has to be maintained at a high vacuum. Otherwise, any gas remaining in the vacuum container adversely affects the electron source so as to deteriorate the electron-emitting performance of the electron source and eventually make the apparatus unable to form a clear and bright image if the gas pressure rises significantly in the inside, although the extent of such an adverse effect depends on the type of the gas contained in the vacuum container. The gas in the vacuum container can be ionized by electron beams and the produced ions can be accelerated by the electric field being applied to the electrons from the electron source before some of the ions collide with the electron source to damage the latter. In some cases, the gas in the vacuum container can give rise to electric discharge in the inside and eventually destroy the image-forming apparatus.

The vacuum container of an image-forming apparatus is typically prepared by assembling glass components and bonding them with frit glass at the junctions thereof. The vacuum condition of the inside of the assembled and bonded vacuum container is maintained by means of a getter arranged within the vacuum container.

The getter in an ordinary CRT is a film of an alloy containing Ba as a principal ingredient and deposited on the inner wall of the container as the alloy is heated electrically or by means of a high frequency wave to evaporate. The deposited alloy adsorbs the gas produced within the container to maintain the inside to an enhanced degree of vacuum.

Meanwhile, there have been developed flat panel displays comprising an electron source realized by arranging a number of electron-emitting devices on a flat substrate. While the vacuum container of such a display apparatus has a volume smaller than that of a CRT, the surface area of the walls of the vacuum container of the display apparatus that can produce gas is not reduced if compared with a CRT. In other words, if the vacuum container of a flat panel display and that of a CRT produce gas to a same extent, the pressure rise in the container can be greater for the former than for the latter and the net result will be more catastrophic to the former. Additionally, while the vacuum container of a CRT has wall surfaces not carrying thereon any electron source or an image-forming member and a getter layer may be formed there, the inner surface area of the walls of the vacuum container of a flat panel display is mostly occupied by an electron source and an image-forming member. Any getter film formed on these components by vapor deposition can adversely affect the performance of the apparatus, giving rise to, for example, a short circuit wiring in it. Thus, the apparatus has a very limited area for forming a getter layer. While wall edges and corners of the vacuum container may be utilized for forming a getter film layer to make the image-forming member and the electron source (hereinafter collectively referred to as "the image display region") free from the gettering substance, such a measure can hardly provide a sufficiently large area for the getter that can satisfactorily adsorb the produced gas if the flat panel display has large dimensions.

In an attempt to solve the above problem and secure a large surface area for the getter, various proposals have been made, including one according to which getter wires are arranged outside the image display region such as the peripheral wall of the display apparatus and a getter film is formed on the wall by vapor deposition in order to provide a sufficient surface area for the getter (Japanese Patent Application Laid-Open No. 5-151916 as schematically shown in cross-section in FIG. 14A), on in which a getter chamber is annexed to a flat panel display in order to form a getter film (Japanese Patent Application Laid-Open No. 4-289640 etc. as schematically shown in FIG. 14B), and one in which a space is provided between the electron source substrate and a rear plate of the vacuum container and a getter film is formed there (Japanese Patent Application Laid-Open No. 1-235152 etc.). With regard to the gas produced in the vacuum container of the flat panel display, there is a problem of local pressure rise in addition to the above-identified one. In an image-forming apparatus comprising an electron source and an image-forming member, gas is mainly produced within the vacuum container from the image-forming member to be irradiated with electron beams and the electron source itself. In a conventional CRT, the image-forming member and the electron source are separated from each other by a large distance and a getter film is formed on the walls of the vacuum container located between them so that the gas produced from the image-forming member disperses in different directions before it gets to the electron source and is partly absorbed by the getter film and, therefore, there occurs no significant pressure rise on the electron source. Additionally, since a getter film is also formed around the electron source itself, the gas discharged from the electron source itself does not accumulate remarkably to produce a significant local pressure rise there. In a flat panel display, to the contrary, the gas produced from the image-forming member can easily accumulate without satisfactorily dispersing to consequently give rise to a significant local pressure rise on the electron source because the image-forming member is located very close to the electron source. This pressure rise is more remarkable at the center than in the peripheral areas of the image display region because gas cannot disperse to get to the getter film. The produced gas can be ionized by electrons from the electron source, which can be accelerated by the electric field existing between the electron source and the image-forming member. Such ions can collide with the electron source to damage the latter and give rise to electric discharge in the inside to eventually destroy the electron source.

In an attempt to cope with this problem, there have been proposed flat panel displays in which a gettering substance is arranged within the image display region in order to immediately adsorb any gas generated in the inside. For instance, Japanese Patent Application Laid-Open No.

4-12436 discloses a method of forming gate electrodes of a gettering substance to be comprised in an electron source to extract electron beams. It describes a field emission type electron source using a conical projection for a cathode and a semiconductor electron source having in junctions. Japanese Patent Application Laid-Open No. 63-181248 discloses a method of arranging a gettering substance on control electrodes (including grid electrodes) to be comprised in a flat panel display in order to control electron beams within the display, said control electrodes being disposed between the cathodes and the face plate of the vacuum container of the display.

U.S. Pat. No. 5,453,659, "Anode Plate for Flat Panel Display having Integrated Getter", issued Sep. 26, 1995, to Wallace et al. discloses a gettering substance arranged in the gap between adjacent stripe-shaped fluorescent bodies in the display. According to the patent invention, the arranged gettering substance is electrically isolated from the fluorescent bodies and the electroconductive bodies electrically connected to the former in the display and the getter is activated by applying a voltage to it and irradiating and heating it with electrons emitted from the electron source of the display or, alternatively, by electrically energizing and heating it.

Needless to say, an electron-emitting device to be used for the electron source of a flat panel display desirably has a simple structure that can be manufactured by a simple method from the view point of technology and manufacturing cost. It is also desirable that such a device can be manufactured by laying thin films to a multilayer structure in a simple manner. A method for manufacturing a large flat panel display should desirably involve a technique such as printing that does not require the use of a vacuum apparatus.

From such a viewpoint, the method of forming gate electrodes of a gettering substance to be comprised in an electron source as disclosed in Japanese Patent Application Laid-Open No. 4-12436 listed above involves manufacturing steps of preparing conical cathode chips, forming junctions of semiconductors and other complicated operations to be carried out in a vacuum apparatus and is not adapted to manufacturing a large electron source because of the limitations relating to the manufacturing apparatus.

While the brightnesses of examples 1, 2, 4, 5, 6, and 7 are different from each other, they did not fall remarkably. The difference of brightness in the beginning is presumed to be caused by the difference of thickness of the getter layers, because the number of electrons passing through a getter layer and reaching fluorescent bodies depends on the thickness of the getter layer.

In the cases of examples 3 and 8, while the efficacy is a little smaller than those of examples 1, 2, 4, 5, 6 and 7, the brightness drop is smaller than that of comparative example 1.

A display apparatus disclosed in Japanese Patent Application Laid-Open No. 63-181248 and comprising control electrodes disposed between the electron source and the face plate of the apparatus inevitably has a complicated configuration and requires cumbersome manufacturing steps for aligning such components.

U.S. Pat. No. 5,453,659 discloses a method of forming a gettering substance on an anode plate of an electron source. However, with this method, the gettering substance has to be electrically insulated from the fluorescent body of the electron source and patterning operations using a photolithography technique have to be repeated for precision processing.

The proposed method therefore involves cumbersome processing steps and the use of a large apparatus for photolithography so that the image-forming apparatuses manufactured by the method are inevitably subject to dimensional limitations.

An electron-emitting device that can meet the requirement of simple manufacturing method may be a lateral field emission type electron-emitting device or a surface conduction electron-emitting device. A lateral field emission type electron-emitting device comprises a cathode having a pointed electron-emitting region and a gate for applying a voltage to the cathode arranged on a flat substrate and is manufactured by means of a thin film deposition technique such as vapor deposition, sputtering or plating and an ordinary photolithography technique. A surface conduction electron-emitting device comprises an electroconductive thin film including a high electric resistance region and emits electrons when an electric current is made to flow therethrough. Such a device is disclosed in Japanese Patent Application Laid-Open No. 7-235255 applied by the application of the present patent application.

Since an electron source comprising surface conduction electron-emitting devices does not have gate electrodes having a configuration as described in Japanese Patent Application Laid-Open No. 4-12436, nor control electrodes as disclosed in Japanese Patent Application Laid-Open No. 63-181248, a getter cannot be arranged in the image display region of an image-forming apparatus provided with such an electron source, unlike the case of the above patent applications, and therefore should be disposed outside the image display region.

As described earlier, the image-forming member that is typically a fluorescent film subject to collisions with highly energized electrons and the electron source itself are the two greatest gas producers in an image-forming apparatus. If the pressure of the produced gas is relatively low, the gas can be adsorbed by the electron-emitting regions of the electron source to adversely affect the performance of the electron source and gas molecules that are ionized by electrons coming from the electron source are accelerated by the voltage applied between the image-forming member and the electron source or between the higher potential side and the lower potential side of the electron source and hit hard the higher potential side or the lower potential side of the electron source to damage it. If the gas pressure rises high locally and instantaneously, ions accelerated by the electric field collide with gas molecules to produce additional ions and consequently give rise to electric discharge within the apparatus. Then, the electron source can be locally destroyed to deteriorate the electron-emitting performance of the electron source. As for the image-forming member that is typically a fluorescent film, $H_2O$ gas and other gas can be abruptly produced from the fluorescent body when electrons are emitted to cause the fluorescent body to fluoresce after the completion of the image-forming apparatus. Thus, the brightness of the image displayed on the display screen of the apparatus can become remarkably reduced in the initial stages of the operation of driving the apparatus. When the apparatus is driven further thereafter, gas can also be produced from areas around the electron source to gradually deteriorate the performance of the image-forming apparatus. So long as a getter is arranged outside the image display region of the apparatus as in the case of conventional image-forming apparatuses, the gas generated at the center of the image display region not only spend a long time before they get to the external getter region but can be adsorbed again by the electron source so that the getter cannot effectively operate to prevent the deterioration of the electron-emitting performance of electron source and the brightness of the image displayed on the image display region can be significantly degraded at the center. In view of the above identified drawbacks of conventional flat panel displays comprising not gate electrodes nor control electrodes, there is a demand for a novel flat panel display having an improved configuration wherein a gettering substance is arranged within the image display region so that any produced gas may be removed quickly and efficiently.

SUMMARY OF THE INVENTION

It is therefore an object of the present invention to dissolve the above identified problems by providing an image-forming apparatus that is substantially free from degradation with time of the brightness of the image being displayed on it.

It is another object of the present invention to provide an image-forming apparatus that is substantially free from deviations with time of the brightness of the image being displayed on it.

It is still another object of the present invention to provide a method of effectively and efficiently activating the getter arranged within an image-forming apparatus according to the invention.

According to a first aspect of the invention, the above objects are achieved by providing an image-forming apparatus comprising an electron source and an image-forming member disposed in an envelope and said image-forming member includes a fluorescent film and a metal back covering the fluorescent film, characterized in that said metal back contains a gettering substance.

According to a second aspect of the invention, there is also provided an image-forming apparatus comprising an electron source having a plurality of electron-emitting devices arranged on a substrate and an image-forming member disposed opposite to said substrate in an envelope, characterized in that a gettering substance is provided in areas other than those of said electron-emitting devices of said substrate disposed opposite to the image-forming region of said image-forming member.

According to a third aspect of the invention, there is also provided a method of activating a getter in an image-forming apparatus according to the invention, characterized in that the getter is activated by irradiating the gettering substance of the getter with electron beams emitted from said electron source and by controlling the voltage being applied to said electron source or the voltage being applied between said electron source and said image-forming member.

DETAILED DESCRIPTION OF THE PREFERRED EMBODIMENTS

Now, the present invention will be described in greater detail by referring to the accompanying drawings that illustrate preferred embodiments of the invention.

Figure 1:
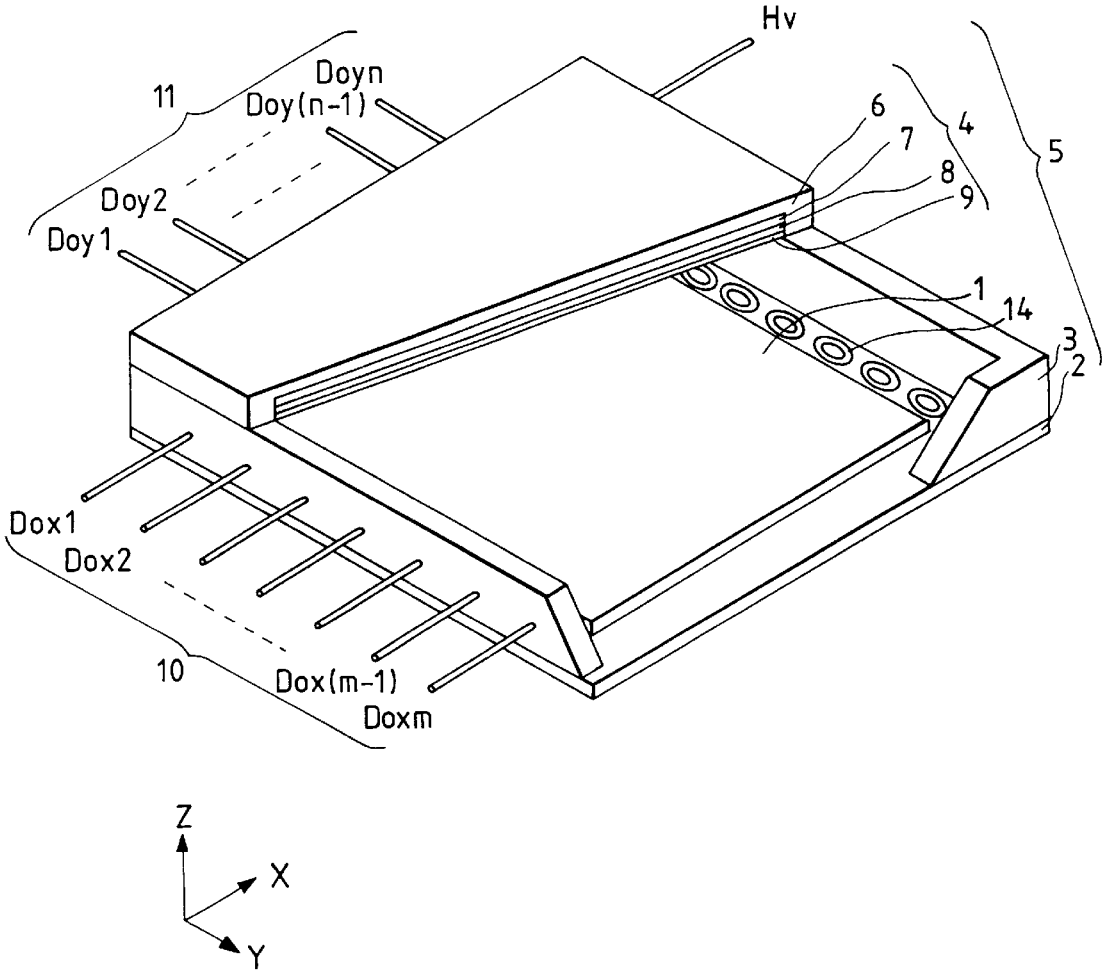
FIG. 1 is a schematic perspective view of a first embodiment of image-forming apparatus according to the invention, illustrating its configuration.

FIG. 1 is a view of a first embodiment of image-forming apparatus according the invention realized by arranging a thin film of an electroconductive gettering substance on a metal back formed on a fluorescent film.

Referring to FIG. 1 schematically illustrating the embodiment of image-forming apparatus, it comprises an envelope 5 formed by bonding an electron source 1 having a plurality of electron-emitting devices arranged on a substrate and wired appropriately, a rear plate 2, a support frame 3 and a face plate 4 together along the junctions thereof. The face plate 4 by turn is formed by arranging a fluorescent film 7, a metal back 8 and a getter layer 9 on a glass substrate 6 to produce an image display region. While the fluorescent film 7 is solely made a fluorescent body in an image-forming apparatus for black and white images, it contains pixels made of fluorescent bodies of three primary colors of red, green and blue that are separated from each other by black electroconductive members in an image-forming apparatus for color images. Such black electroconductive members are referred to as black stripes or a black matrix, which will be described hereinafter in greater detail. The metal back is made of an electroconductive thin film typically of aluminum. As will be described hereinafter, it may alternatively be made of a gettering substance so that it may also operate as a getter layer. The metal back is designed to improve the brightness of the display screen by reflecting beams of light coming from the fluorescent bodies and moving to ward the electron source such that they may be directed along the direction toward the glass substrate and, at the same time, prevent ions generated as a result of ionization of the gas remaining in the envelope by electron beams from damaging the fluorescent bodies. It also operates as anode relative to the electron source and imparts electroconductivity to the image display region of the face plate to prevent any electric charge from accumulating there.

The getter layer formed on the face plate characterizes an image-forming apparatus according to one aspect of the invention and is designed to adsorb the gas produced by the electron source and the face plate.

Note that, if the getter layer operates as a metal back, it should be sufficiently electroconductive.

In general, if the electric resistance of a thin film having a thickness t, a width w and a length l is equal to R, a "sheet resistance" Rs is defined by equation $R=Rs(l/w)$ and Rs should not have a large value for the film to show a sufficiently large electroconductivity. If the thin film is structurally uniform, Rs and the electric resistivity $\rho$ of the substance of the thin film have a relationship $Rs=\rho/t$. Thus, t should have a relatively large value. Additionally, the getter is required to have a relatively large volume in order for it to adsorb gas to a satisfactory extent. This means that t should not be very small for the getter to operate well and there may be defined a lower limit for it.

On the other hand, the metal back should be sufficiently thin to allow incident electron beams to move therethrough and get to the fluorescent bodies. The thickness t of the metal back, the intensity Io of incident electrons and the intensity It of transmitting electrons show a relationship roughly expressed by $It=Io\ \exp\{-t(lo)\}$. lo is the mean free path of electrons in the metal back and defined by the material of the metal back and the energy of incident electrons. However, since it is affected by the ratio of elastic scattering to inelastic scattering observed therein, the particulate structure of the films of the metal back and other factors, it should be experimentally determined.

If the gettering substance is not very thick, it may alternatively be formed on an aluminum metal back as a uniform layer. If such is the case, since the metal back has a sufficiently large electroconductivity, the layer of the gettering substance may be made thin so long as it operates effectively.

Preferably, the gettering substance is arranged selectively on the black stripes or the black matrix of the fluorescent film (with the metal back interposed therebetween) so that electrons may not be absorbed by the gettering substance and hence the layer of the gettering substance may be made sufficiently thick.

An image-forming member having a configuration as described above can be manufactured in a relatively simple process because the gettering substance and the fluorescent bodies are electrically connected. It can be manufactured by a method much simpler than by the method disclosed in U.S. Pat. No. 5,453,659 "Anode Plate" cited earlier and, therefore, it can adapt itself to large dimensions. If the gettering substance is patterned, it is not necessary to electrically insulate it from the fluorescent bodies and hence no rigorous control is required for the patterning operation. A patterned film of a gettering substance can be easily produced by arranging an appropriate mask on the metal back and forming a film of the gettering substance by means of vacuum deposition or sputtering. The reasons why an image-forming member can be arranged in such a simple way for the purpose of the present invention as compared with U.S. Pat. No. 5,453,659 will be described hereinafter.

The gettering substance may be selected from known ordinary substances having a sufficiently high electroconductivity including metals such as Ti, Zr, Hf, V, Nb, Ta and W and their alloys. Alloys that can be used for the purpose of the present invention may contain Al, Fe and/or Ni.

As means for securing a sufficiently high electroconductivity for the getter even when it has adsorbed gas to a large extent, the basic substance of the getter may be made to contain a metal that is less reactive than the former. More specifically, such an auxiliary metal may have an electronegativity value greater than that of the element that provides the base for the getter. Then, when Zr or Ti contained in the gettering substance is oxidized by the adsorbed gas, the other metal element can remain unoxidized to secure the electroconductivity of the getter. Such a combination of two metals for an alloy may be Ti (electronegativity of 1.5) or Zr (1.4) and Fe or Ni (both having an electronegativity of 1.8). A metal having a large electronegativity other than Fe and Ni may also be used.

Referring back to FIG. 1, the embodiment additionally comprises row selection terminals 10 and signal input terminals for applying a signal for controlling the rate of electron emission of the electron-emitting devices of the selected row. These terminals may have a profile appropriately selected by taking the configuration of the electron source and the method of controlling it into consideration and, therefore, not limited to the illustrated ones.

Figure 2A:
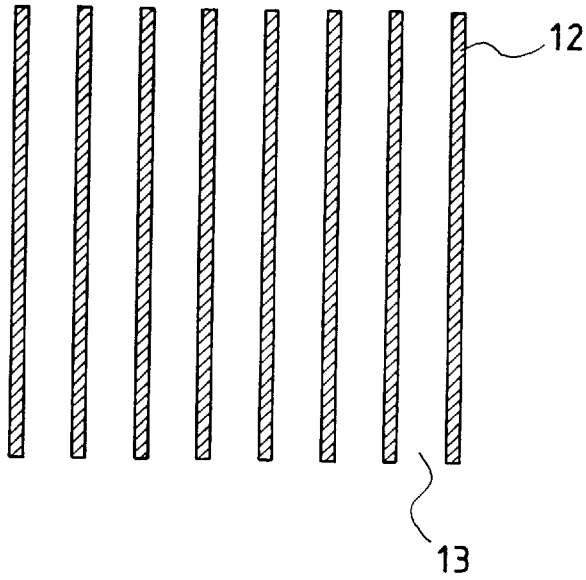
FIG. 2A is a schematic plan view of a fluorescent film having black stripes.
Figure 2B:
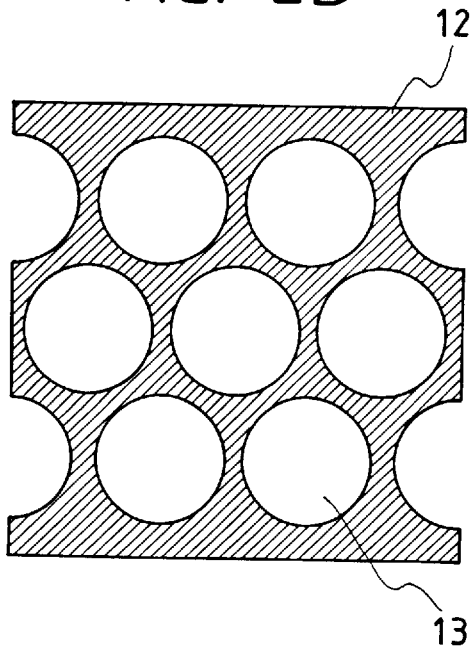
FIG. 2B is a schematic plan view of a fluorescent film having a black matrix.

Now, the fluorescent film will be described in detail. FIG. 2A shows stripe-shaped fluorescent bodies 13 arranged in a sequence of three primary colors of red (R), green (G) and blue (B) and separated from each other by black electroconductive members 12, which are referred to black stripes. In FIG. 2B, dot-shaped fluorescent bodies 13 are disposed in a grating arrangement and separated from each other by a matrix of a black electroconductive substance 12. Dots of fluorescent bodies of three primary colors may be arranged in several different ways and a square grating arrangement instead of a triangular grating arrangement as illustrated in FIG. 2B.

A black electroconductive material 12 and fluorescent bodies may be arranged on a glass substrate 6 to show a predetermined pattern by means of an appropriate patterning operation using a slurry or printing technique. After forming a fluorescent film, a metal film typically of aluminum is prepared thereon as metal back, on which a layer of a gettering substance is formed. When a layer of a gettering substance is selectively formed only on the black matrix or black stripes, a mask having an appropriate pattern of openings has to be rigorously aligned with and secured to the metal back. Care should be taken to place the mask as close as possible to the metal back without contacting the latter. Then, a layer of a gettering substance that may be made of a metal such as Ti or Zr or an alloy containing such a metal is formed on the fluorescent film or the metal back by sputtering or vacuum deposition. Preferably a thin stabilized layer of a nitride may be additionally formed on the surface of the gettering substance layer in order to handle the gettering substance layer with ease in the subsequent processing steps. Such a nitride layer may be prepared by introduce nitrogen gas into the vacuum apparatus and heating it after forming the getter layer. The produced nitride layer is removed in a subsequent "getter activation step (as will be described hereinafter)".

The face plate 4 prepared in the above described manner is then combined with a support frame 3, a rear plate 2, an electron source substrate 1 and other components, of which the support frame 3, the face plate 4 and the rear plate 2 are bonded together by means of frit glass at 400° C. At the same time, the internal components such as the electron source substrate 1 are also rigidly secured in position. In practice, the assembled components are heated to 300° C. in the atmosphere to eliminate the binding agent contained in the frit glass (an operation referred to as "preliminary baking") and, thereafter, they are heated further to 400° C. in an atmosphere of inert gas such as Ar to bond the junctions of the components.

Subsequently, the electron source is subjected to activation and other necessary processing steps and, after evacuating the inside of the envelope 5, the exhaust pipe (not shown) of the envelope is heated and sealed off by means of a burner. Thereafter, the apparatus is subjected to a gettering operation, where evaporation type getters 14 (schematically shown as ring-shaped getters in FIG. 1) that are different from the above described getter layer are heated until they evaporate and are deposited on the inner walls of the envelope 5 (an operation referred to as "a flash" of getter) to form a film. The formed getter film is located outside the image display region within the envelope 5.

Then, the layer 9 of the gettering substance formed on the face plate is subjected to an activation step.

For the purpose of the invention, "activation" refers to two different operations. Firstly, electron-emitting devices are subjected to an operation of activation. When electron-emitting devices are formed for an image-forming apparatus to show a macroscopically satisfactory profile, they may not emit electrons at all or, if they do, only at a low rate. Then, they have to be subjected to an operation of activation, where the surface of the devices are qualitatively modified so that they emit electrons at a desired high rate. Secondly, there is another operation of activation that is conducted on a gettering substance. As described above, the surface of a non evaporation type getter containing Zr or Ti as a principal ingredient is covered by a nitride layer so that the getter may remain stabilized and is handled without difficulty. Then, it is heated in vacuum to diffuse the nitrogen atoms into the gettering substance to make the surface neat and clean and the getter operate properly. In order to avoid confusion, the operation of activating a gettering substance will be referred to as "getter activation" hereinafter whenever deemed necessary.

For the embodiment of image-forming apparatus shown in FIG. 1, the initial operation of getter activation may be carried out by externally heating it or by modifying the tracks of electrons emitted from electron-emitting devices from those for displaying an image so as to irradiate the getter layer with electron beams. When lateral type field emission electron-emitting devices or surface conduction electron-emitting devices are used, the tracks of electrons can be modified by appropriately changing the voltage being applied to the electron-emitting devices and the voltage being applied between the devices and the metal back.

When the operation of getter activation is carried out by means of electron beams emitted from the electron-emitting devices of the image-forming apparatus as described above, no particular arrangement has to be installed for the operation. Thus, if the gas adsorbing effect of the gettering substance is reduced after the image-forming apparatus has been put to use, the getter may be effectively "reactivated" by means of electron beams.

The momentum of an electron emitted from a lateral type field emission electron-emitting device or a surface conduction electron-emitting device of the electron source of an image-forming apparatus according to the invention has a component running along a particular direction parallel to the electron source substrate ("lateral direction") because of the specific structure of the device. (It is not a component that each electron randomly shows due to the diffusion of electron beam but a component that each electron of the electron beam shows averagely.) In other words, the electron beam emitted from an electron-emitting device hits the image-forming member at a position slightly displaced from the spot right above the electron-emitting device. Although the electron source and the image-forming member are normally aligned, taking this displacement into consideration, such displacement can be regulated by appropriately modifying the voltage Vf to be applied to the devices and the voltage Va to be applied between the devices and the image-forming member (anode). On the basis of this principle, an electron beam emitted to hit a fluorescent body can be made to hit an adjacent black electroconductive member. Thus, the gettering substance arranged on a black electroconductive member of an image-forming apparatus according to the invention can be irradiated with electron beams without using the complicated arrangement of U.S. Pat. No. 5,453,659.

In a second preferred embodiment of image-forming apparatus according to the invention, a getter layer is formed in areas other than the electron-emitting device on the electron source substrate. As in the case of the first embodiment, while a specific wiring arrangement is required for this embodiment in order to apply a voltage to the getter layer if the operation of getter activation is carried out by means of electron beams emitted from the electron-emitting devices, the higher potential side wire of each electron-emitting device may be used or, alternatively, an exclusive wire may be arranged for that purpose.

Figure 3A:
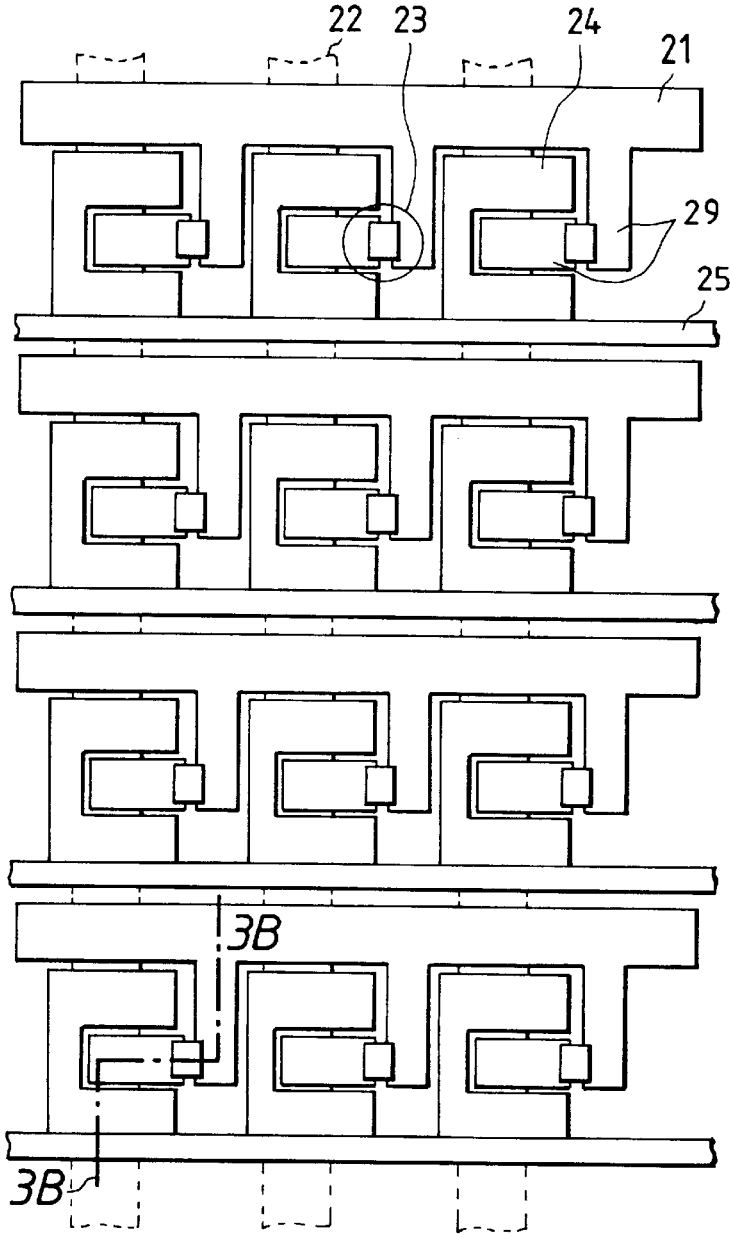
FIG. 3A is a schematic partial plan view of another embodiment of an image-forming apparatus according to the invention, illustrating its configuration.
Figure 3B:
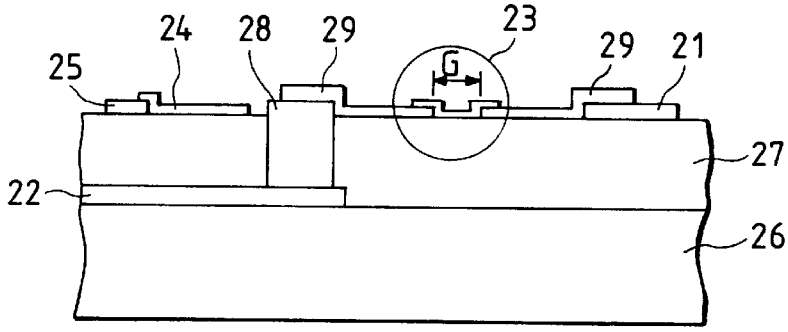
FIG. 3B is a schematic partial sectional view taken along line 3B—3B in FIG. 3A.

FIGS. 3A and 3B schematically illustrate a getter layer formed on an insulation layer and disposed close to a related one of the electron-emitting devices of an electron source having a matrix wiring arrangement. FIG. 3A is a partial plan view of the electron source and FIG. 3B is a sectional view taken along line 3B-3B in FIG. 3A. While surface conduction electron-emitting devices are shown there, they may well be replaced by electron-emitting devices of a different type.

The embodiment comprises X-directional wires (upper wires) 21 and Y-directional wires (lower wires) 22 that are respectively connected the related electron-emitting devices. Each of the electron-emitting devices is provided with a specific area located close to it, where a getter layer is formed and connected to a getter activation wire 25 so that an appropriate voltage may be applied to the getter layer for getter activation. The Y-directional wires are arranged on an insulating substrate 26 and an insulation layer 27 is formed thereon. The X-directional wires 21, the electron-emitting devices 23, the getter layers 24 and the getter activation wires 25 are arranged on the insulation layer 27. Each of the electron-emitting devices 23 is connected to a related one of the Y-directional wires 22 by way of a contact hole 28. Reference numeral 29 denotes connecting wires.

The above cited various wires are formed by means of a combination of a thin film deposition technique such as sputtering, vacuum deposition or plating and photolithography or by printing. As described earlier, the getter layer is formed of a metal such as Zr or Ti or an alloy containing such a metal by means of sputtering and then the surface of the layer is treated with a nitride.

The electron source substrate is then assembled with a face plate, a support frame and a rear plate as in the case of the first embodiment to produce an image-forming apparatus. The face plate may be a metal back carrying thereon a layer of a gettering substance as in the case of the first embodiment or, alternatively, carrying thereon no gettering substance layer so long as the apparatus meets the requirements of a given degree of vacuum and a certain service life.

After the electron-emitting devices of the embodiment are subjected to energization forming and activation as in the case of the first embodiment, the internal pressure of the envelope is reduced to a sufficiently low level of less than $10^{-5}$ Pa and then an operation of getter activation is carried out on the apparatus. The operation of getter activation may be conducted by heating the apparatus as in the case of the first embodiment or by causing the electron-emitting devices 23 to emit electron beams and simultaneously applying a voltage higher than the potential of the higher potential electrodes of the electron-emitting devices to the getter layers 24 by way of the getter activation wires 25 to draw the electron beams toward the respective getter layers 24 and energize the getter layers 24 by electrons. The metal back of the face plate may be made to have a negative potential in order to deviate the electron beams.

Thereafter, the exhaust pipe of the image-forming apparatus is sealed off and the vapor deposition type getter is made to flash. Note that the sequence of the operations of getter layer activation, sealing off of the exhaust pipe and flashing of the vapor deposition type getter may be changed if necessary.

The same treatment as the getter activation discrived above can be carried out when the ability of the getter layers is exhausted or periodically for re-activation of the getter layers. Still more, carrying out the same treatment simultaneously with displaying images for maintaining surfaces of the getter layers clean is effective to avoid generation of gases and discharge caused by such gases.

As methods for this treatment, for example, supplying to the getter layers an electrical potential higher than that of the higher potential side electrodes of the electron emitting devices can be utilized. Because of the potential of the getter layers, electrons emitted from the electron emitting devices are partially attracted by the getter layers, though a majority of electrons emitted from electron emitting devices are attracted by the face plate.

Surfaces of the getter layers were heated by collision of electrons, and this accelerates diffusion of absorbed molecules into inside of the getter layers.

This treatment can be carried out constantly with an appropriate interval during displaying images.

Depending on situations, any suitable method can be selected. As a method of heating getter layers for reactivation or cleaning, heating means may be formed on the electron source substrate.

In a third preferred embodiment of image-forming apparatus according to the invention, a getter layer is formed on the higher potential side wires of the electron source that are exposed on the electron source substrate. When forming the wires, a getter layer may be formed on a layer of the material of the wires (such as Au or Pt) and the two layers may be patterned all at once. In such cases, no activation wire is needed. In short, the third embodiment can be manufactured with a simpler process than the second embodiment and has a configuration simpler than that of the second embodiment.

The operation of getter activation may be conducted by heating the embodiment or by causing the electron-emitting devices to emit electron beams and making them collide with the getter layers arranged on the wires by applying a negative potential to the metal back on the face plate.

Figure 4:
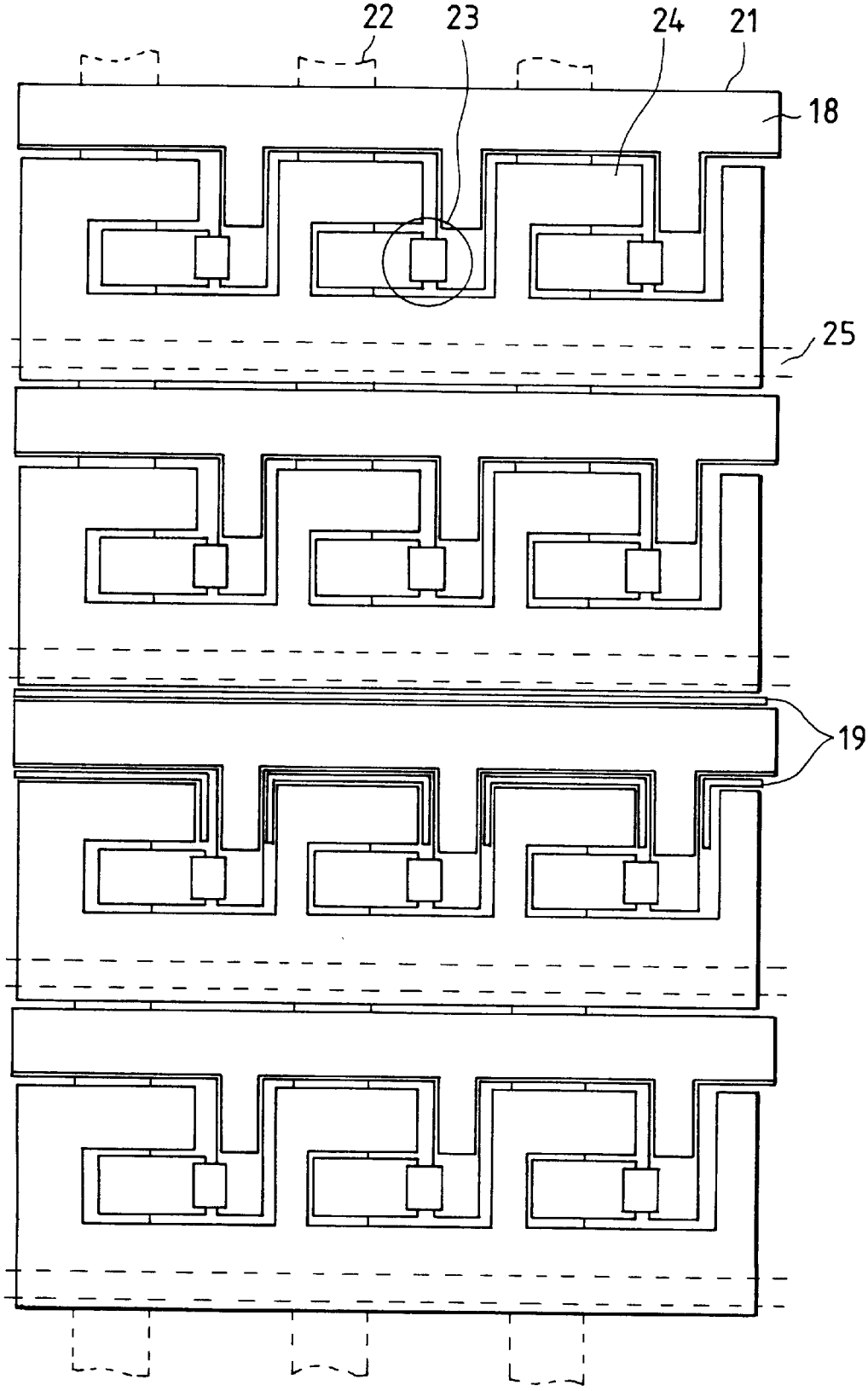
FIG. 4 is a schematic partial plan view of still another embodiment of an image-forming apparatus according to the invention.

A fourth embodiment of image-forming apparatus according to the invention and illustrated in FIG. 4 is in fact a combination of the second and third embodiments. In FIG. 4, reference numeral 26 denotes getter layers formed on the higher potential side (X-directional) wires 21. With this arrangement, the total area of the getter layers can be further increased. The getter layers may be formed individually or by covering the areas for electron-emitting devices 23 with a mask, forming a film of a gettering substance and thereafter carrying out a laser patterning operation of separating the getter layers 26 on the higher potential side wires from the remaining getter film 24 connected to the getter activation wires 25 by means of a scanning laser spot. Reference numeumeral 27 in FIG. 4 denotes scanning paths along which a laser spot moves for a laser patterning operation.

In a fifth embodiment of image-forming apparatus according to the invention, the getter layers are made of an evaporation type gettering substance that is an alloy containing Ba as a principal ingredient.

However, care should be taken not to give rise to a problem of short circuiting that may arise when a getter film is formed in any unnecessary areas. A holder made of the gettering substance may have to be devised to confine the direction along which the evaporated gettering substance moves when the evaporation type gettering substance is heated. More specifically, getter layers may be formed by vapor deposition only on desired areas of the higher potential side wires by arranging wires of the gettering substance directly above the higher potential side wires and forming slits thereon on the side of the higher potential side wires along the longitudinal direction of the wires of the gettering substance. With this arrangement, an independent activation step can be omitted because the getter layers formed by vapor deposition adsorb any gas within the envelope of the image-forming apparatus. While the above description of the second to the fifth embodiments are based on an electron source with matrix wiring, they may be applicable to an electron source having a ladder-like arrangement or some other arrangement.

As described above, according to the invention, getter layers can be formed not only over a wide area but also close to sites where as is produced most vigorously when the electron source is driven to operate by forming getter layers on the metal back in the image display region of the face plate, on the insulating members of the electron source substrate or on the higher potential side wires so that the internal pressure of the envelope of an image-forming apparatus according to the invention can be constantly held to a low level and any gas produced in the inside can be quickly adsorbed by the getter. Thus, an image-forming apparatus according to the invention is free from deterioration or fluctuations in the light emitting performance due to gas produced in the inside.

Figure 5:
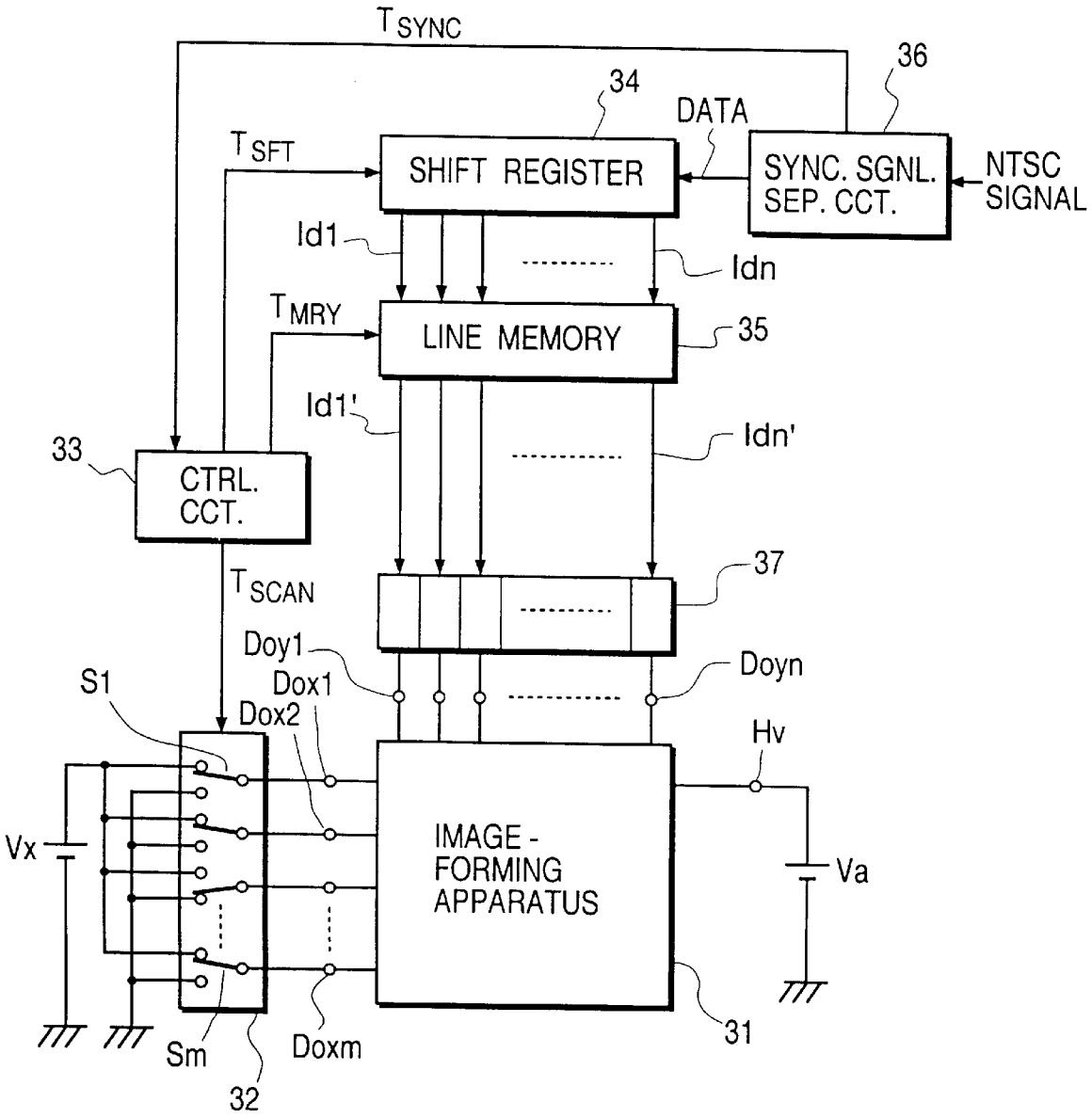
FIG. 5 is a schematic block diagram of a drive circuit of an image-forming apparatus according to the invention and designed to display images according to NTSC signals.

Now, a drive circuits for driving an image-forming apparatus as described above according to NTSC television signals will be described by referring to FIG. 5. In FIG. 5, reference numeral 31 denotes an image-forming apparatus according to the invention. Otherwise, the circuit comprises a scan circuit 32, a control circuit 33, a shift register 34, a line memory 35, a synchronizing signal separation circuit 36 and a modulation signal generator 37. Vx and Va in FIG. 5 denote DC voltage sources.

As shown in FIG. 5, the image-forming apparatus 31 is connected to external circuits via terminals Dox1 through Doxm, Doy1 through Doyn and a high voltage terminal Hv, of which terminals Dox1 through Doxm are designed to receive scan signals for sequentially driving on a one-by-one basis the rows (of N devices) of an electron source in the apparatus comprising a number of surface-conduction type electron-emitting devices arranged in the form of a matrix having M rows and N columns.

On the other hand, terminals Doy1 through Doyn are designed to receive a modulation signal for controlling the output electron beam of each of the surface-conduction type electron-emitting devices of a row selected by a scan signal. High voltage terminal Hv is fed by the DC voltage source Va with a DC voltage of a level typically around 10 kV, which is sufficiently high to energize the fluorescent bodies of the selected surface-conduction type electron-emitting devices.

The scan circuit 32 operates in a manner as follows. The circuit comprises M switching devices (of which only devices S1 and Sm are specifically and schematically indicated in FIG. 5), each of which takes either the output voltage of the DC voltage source Vx or 0V (the ground potential level) and comes to be connected with one of the terminals Dox1 through Doxm of the image-forming apparatus 31. Each of the switching devices S1 through Sm operates in accordance with control signal Tscan fed from the control circuit 33 and can be prepared by combining transistors such as FETs.

The DC voltage source Vx of this circuit is designed to output a constant voltage such that any drive voltage applied to devices that are not being scanned due to the performance of the surface conduction electron-emitting devices (or the threshold voltage for electron emission) is reduced to less than threshold voltage.

The control circuit 33 coordinates the operations of related components so that images may be appropriately displayed in accordance with externally fed video signals. It generates control signals Tscan, Tsft and Tmry in response to synchronizing signal Tsync fed from the synchronizing signal separation circuit 36, which will be described below.

The synchronizing signal separation circuit 36 separates the synchronizing signal component and the luminance signal component form an externally fed NTSC television signal and can be easily realized using a popularly known frequency separation (filter) circuit. Although a synchronizing signal extracted from a television signal by the synchronizing signal separation circuit 36 is constituted, as well known, of a vertical synchronizing signal and a horizontal synchronizing signal, it is simply designated as Tsync signal here for convenience sake, disregarding its component signals. On the other hand, a luminance signal drawn from a television signal, which is fed to the shift register 34, is designated as DATA signal for convenience sake.

The shift register 34 carries out for each line a serial/parallel conversion on DATA signals that are serially fed on a time series basis in accordance with control signal Tsft fed from the control circuit 33. In other words, a control signal Tsft operates as a shift clock for the shift register 34. A set of data for a line that have undergone a serial/parallel conversion (and correspond to a set of drive data for n electron-emitting devices) are sent out of the shift register 34 as n parallel signals Id1 through Idn.

The line memory 35 is a memory for storing a set of data for a line, which are signals Id1 through Idn, for a required period of time according to control signal Tmry coming from the control circuit 33. The stored data are sent out as I'd1 through I'dn and fed to modulation signal generator 37.

Said modulation signal generator 37 is in fact a signal line that appropriately drives and modulates the operation of each of the surface-conduction type electron-emitting devices according to each of the image data I'd1 through I'dn and output signals of this device are fed to the surface-conduction type electron-emitting devices in the image-forming apparatus 31 via terminals Doy1 through Doyn.

An electron-emitting device applicable to the present invention has a characteristic feature relative to emission current Ie as will be described below. There exists a clear threshold voltage Vth for an electron-emitting device and the device emits electrons only a voltage exceeding the threshold voltage Vth is applied thereto. The level of emission current changes as a function of the change in the applied voltage above the threshold level. While the value of the threshold voltage and the relationship between the applied voltage and the emission current may vary depending on the materials, the configuration and the manufacturing method of the electron-emitting device, the following description holds true in any case. When a pulse-shaped voltage is applied to an electron-emitting device according to the invention, practically no emission current is generated so far as the applied voltage remains under the threshold level, whereas an electron beam is emitted once the applied voltage rises above the threshold level. It should be noted here that, firstly, the intensity of an output electron beam can be controlled by changing the wave height value Vm of the pulse-shaped voltage. Secondly, the total amount of electric charge of the electron beam emitted from the device can be controlled by varying the pulse width Pw of the pulse-shaped voltage.

Thus, either voltage modulation method or pulse width modulation may be used for modulating an electron-emitting device in response to an input signal. With voltage modulation, a voltage modulation type circuit is used for the modulation signal generator 37 so that the peak level of the pulse shaped voltage is modulated according to input data, while the pulse width is held constant.

With pulse width modulation, on the other hand, a pulse width modulation type circuit is used for the modulation signal generator 37 so that the pulse width of the applied voltage may be modulated according to input data, while the peak level of the applied voltage is held constant.

Although it is not particularly mentioned above, the shift register 34 and the line memory 35 may be either of digital or of analog signal type so long as serial/parallel conversions and storage of video signals are conducted at a given rate.

If digital signal type devices are used, output signal DATA of the synchronizing signal separation circuit 36 needs to be digitized. However, such conversion can be easily carried out by arranging an A/D converter at the output of the synchronizing signal separation circuit 36. It may be needless to say that different circuits may be used for the modulation signal generator 37 depending on if output signals of the line memory 35 are digital signals or analog signals. If digital signals are used, a D/A converter circuit of a known type may be used for the modulation signal generator 37 and an amplifier circuit may additionally be used, if necessary. As for pulse width modulation, the modulation signal generator 37 can be realized by using a circuit that combines a high speed oscillator, a counter for counting the number of waves generated by said oscillator and a comparator for comparing the output of the counter and that of the memory. If necessary, am amplifier may be added to amplify the voltage of the output signal of the comparator having a modulated pulse width to the level of the drive voltage of a surface-conduction type electron-emitting device according to the invention.

If, on the other hand, analog signals are used with voltage modulation, an amplifier circuit comprising a known operational amplifier may suitably be used for the modulation signal generator 37 and a level shift circuit may be added thereto if necessary. As for pulse width modulation, a known voltage control type oscillation circuit (VCO) may be used with, if necessary, an additional amplifier to be used for voltage amplification up to the drive voltage of surface-conduction type electron-emitting device.

With an image forming apparatus according to the invention and comprising an image-forming apparatus 31 and a drive circuit a configuration as described above, the electron-emitting devices emit electrons as a voltage is applied thereto by way of the external terminals Dox1 through Doxm and Doy1 through Doyn. Then, the generated electron beams are accelerated by applying a high voltage to the metal back 8 or a transparent electrode (not shown) by way of the high voltage terminal Hv. The accelerated electrons eventually collide with the fluorescent film 114, which by turn fluoresces to produce television images.

The above described configuration of image forming apparatus is only an example to which the present invention is applicable and may be subjected to various modifications. The TV signal system to be used with such an apparatus is not limited to a particular one and any system such as NTSC, PAL or SECAM may feasibly be used with it. It is particularly suited for TV signals involving a larger number of scanning lines (typically of a high definition TV system such as the MUSE system because it can be used for a large imageage-forming apparatus comprising a large number of pixels.

Possible applications of an image-forming apparatus according to the invention include a display apparatus for television, a teleconferencing system and a computer as well as an optical printer comprising a photosensitive drum.

EXAMPLES

Now, the present invention will be described in greater detail by way of examples.

Example 1

The image-forming apparatus of this example has a configuration as schematically illustrated in FIG. 1 and the metal back 8 of the apparatus is totally covered by a getter film 9.

In the image-forming apparatus of this example, a plurality of surface conduction electron-emitting devices are arranged and wired on an electron source substrate 1 to form an electron source having a simple matrix arrangement (with 100 rows and 300 columns).

Figure 15:
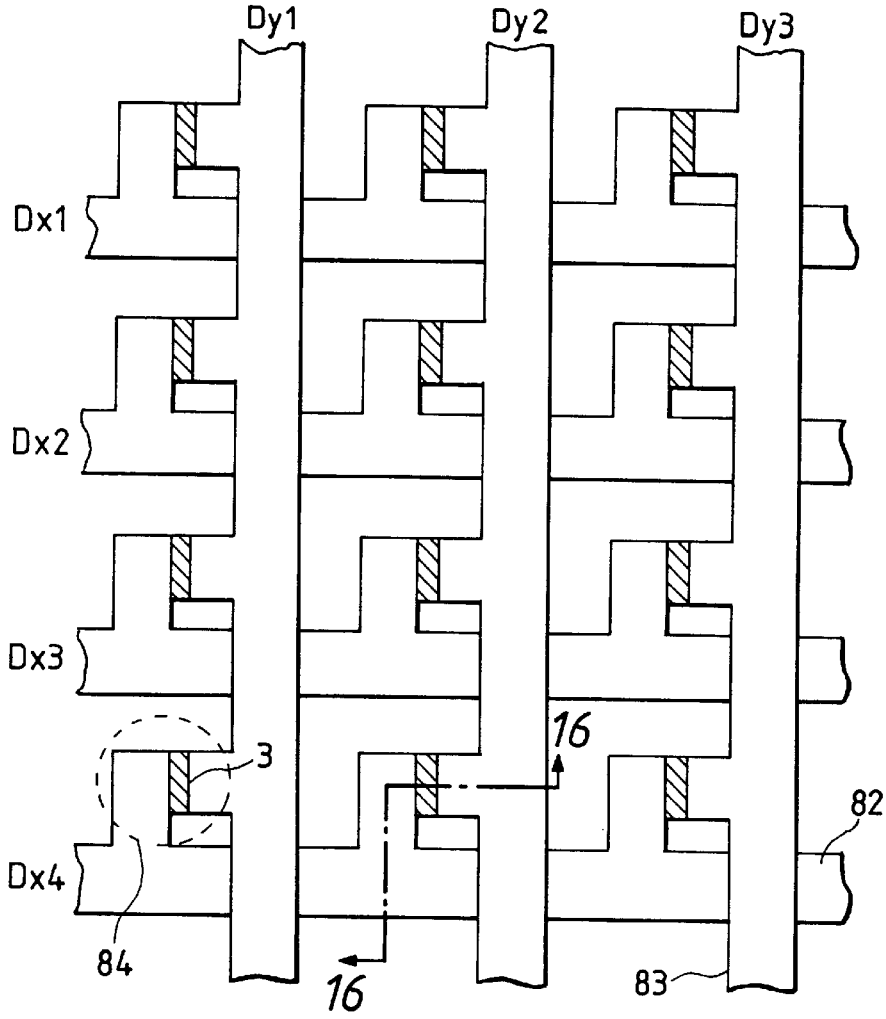
FIG. 15 is a schematic partial plan view of an electron source comprising a plurality of surface conduction electron-emitting devices arranged with matrix wiring.
Figure 16:
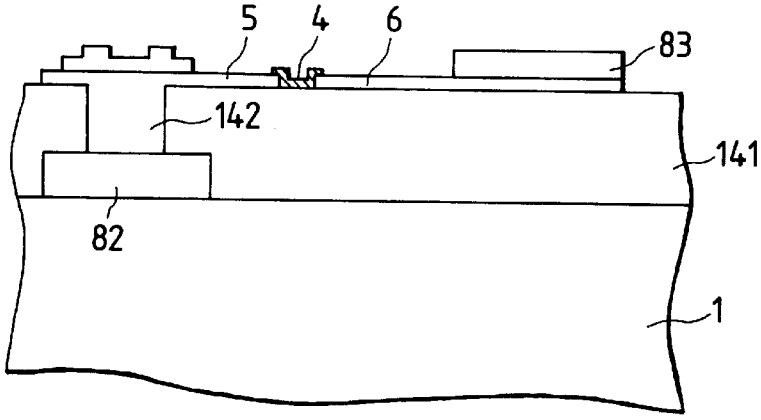
FIG. 16 is a schematic partial sectional view taken along line 16—16 in FIG. 15.

FIG. 15 is a partial plan view of the electron source. FIG. 16 is a cross sectional view taken along line 16—16 in FIG. 15. In FIGS. 15 and 16, same components are denotes by same reference symbols. 1 denotes an electron source substrate and 82 denotes an X-directional wire (also referred to as a lower wire) that corresponds to Doxm in FIG. 1, while 83 denotes a Y-directional wire (also referred to an upper wire) that corresponds to Doyn in FIG. 1. 4 denotes an electroconductive film including an electron-emitting region and 5 and 6 denote device electrodes. Otherwise, there are shown an interlayer insulation layer 141 and a contact hole 142 for electrically connecting the device electrode 5 and the lower wire 82.

The image-forming apparatus of this example is prepared in a manner as described below.

Figure 17A:
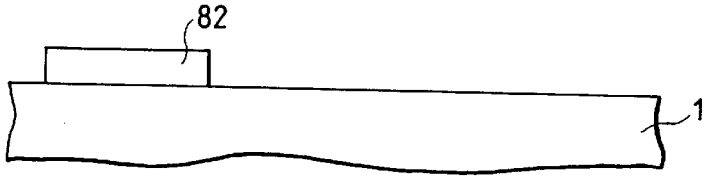
FIGS. 17A through 17H are schematic partial sectional views of the electron source of FIG. 15, illustrating it in different manufacturing steps.

Step a:

After thoroughly cleansing a soda lime glass plate, a silicon oxide film was formed thereon to a thickness of 0.5 $\mu$m by sputtering to produce a substrate 1, on which Cr and Au were sequentially laid to thicknesses of 5 nm and 600 nm respectively and then photoresist (AZ1370: available from Hoechst Corporation) was applied thereto by means of a spinner, while rotating the film, and baked. Thereafter, a photo-mask image was exposed to light and developed to produce a resist pattern for lower wires 82 and then the deposited Au/Cr film was wet-etched to produce lower wires 82 having an intended profile (FIG. 17A).

Figure 17B:
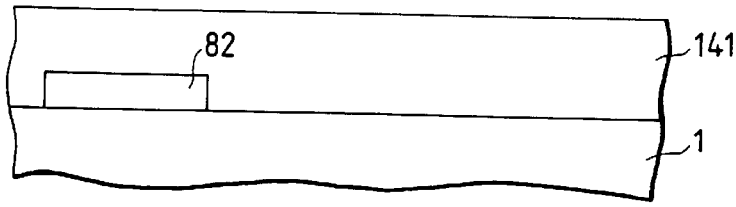

Step b:

A silicon oxide film was formed as an interlayer insulation layer 141 to a thickness of 1.0 $\mu$m by RF sputtering (FIG. 17B).

Figure 17C:
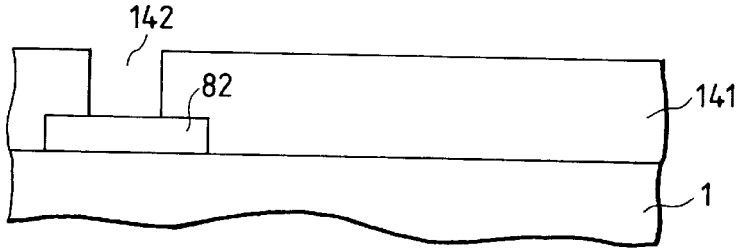

Step c:

A photoresist pattern was prepared for producing a contact hole 142 in the silicon oxide film deposited in Step b, which contact hole 142 was then actually formed by etching the interlayer insulation layer 141, using the photoresist pattern for a mask. A technique of RIE (Reactive Ion Etching) using $CF_4$ and $H_2$ gas was employed for the etching operation (FIG. 17C).

Figure 17D:
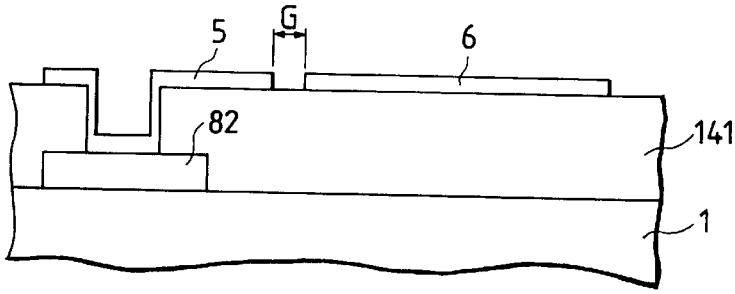

Step d:

Thereafter, a pattern of photoresist (RD-2000N-41: available from Hitachi Chemical Co., Ltd.) was formed for device electrode 5 and a gap separating the pair of electrodes and then Ti and Ni were sequentially deposited thereon respectively to thicknesses of 5 nm and 100 nm by vacuum deposition for each surface conduction electron-emitting device. The photoresist pattern was dissolved by an organic solvent and the Ni/Ti deposit film was treated by using a lift-off technique to produce a pair of device electrodes 5, 6 having a width W of 300 $\mu$m and separated from each other by a distance L of 3 $\mu$m for each electron-emitting device (FIG. 17D).

Figure 17E:
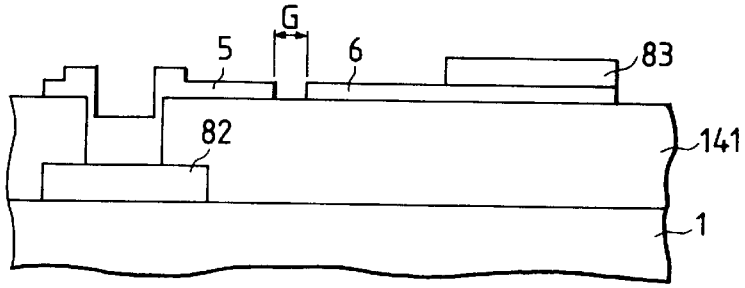

Step e:

After forming a photoresist pattern on the device electrodes 5, 6 for upper wires 83, Ti and Au were sequentially deposited by vacuum deposition to respective thicknesses of 5 nm and 500 nm and then unnecessary areas were removed by means of a lift-off technique to produce upper wires 84 (FIG. 17E).

Figure 17F:
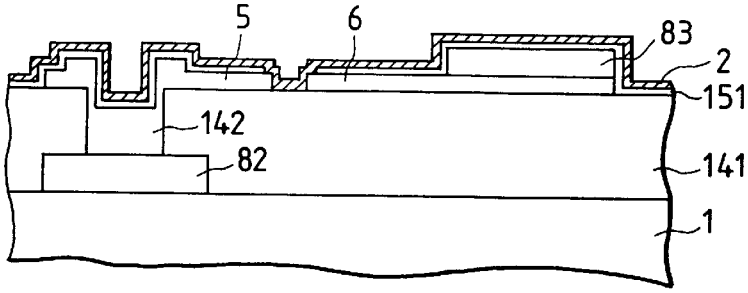

Step f:

A Cr film 151 was formed to a film thickness of 100 nm by evaporation, which was then subjected to a patterning operation. Thereafter, a solution of Pd amine complex (ccp4230: available from Okuno Pharmaceutical Co., Ltd.) was applied to the Cr film by means of a spinner, while rotating the film, and baked at 300° C. for 10 minutes. The formed electroconductive film 2 for producing an electron-emitting region was made of fine particles containing Pd as a principal ingredient and had a film thickness of 8.5 nm and an electric resistance $Rs=3.9\times10^4\Omega/\square$. Note that, an electroconductive film of fine particles is a film made of aggregated fine particles, where fine particles may be in a dispersed, adjacently arranged or overlapped (to show an islands structure) state, the fine particles having a diameter recognizable in any of the above listed states (FIG. 17F).

Figure 17G:
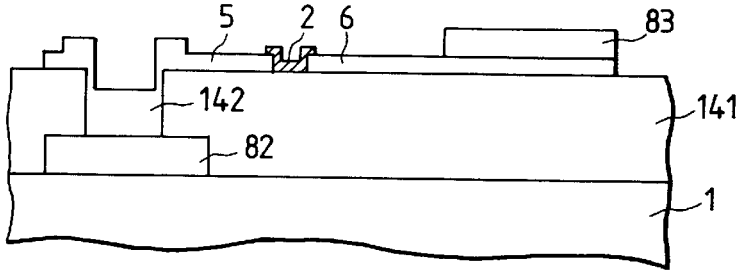

Step g:

The Cr film 151 and the baked electroconductive film 2 for forming an electron-emitting region was etched to show a desired pattern by means of an acidic etchant (FIG. 17G).

Figure 17H:
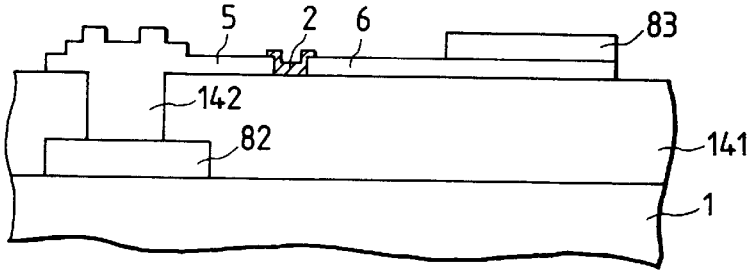

Step h:

Then, a pattern for applying photoresist to the entire surface area except the contact hole 142 was prepared and Ti and Au were sequentially deposited by vacuum deposition to respective thicknesses of 5 nm and 500 nm. Any unnecessary areas were removed by means of a lift-off technique to consequently bury the contact hole 142 (FIG. 17H).

By following the above steps, a plurality (100 rows×300 columns) electroconductive films 2 for forming electron-emitting regions that are respectively connected to the upper wires 83 and the lower wires 82 were produced in the form of a matrix on the electron source substrate 1.

Step i:

Thereafter, a face plate 4 having a profile as shown in FIG. 1 was prepared in a following manner.

A fluorescent film 7 was formed on a glass substrate 6 by printing. The fluorescent film 7 carried thereon stripe-shaped fluorescent bodies (R, G, B) 13 and black electroconductive members (black stripes) 12 arranged alternately to show an arrangement of FIG. 2A.

A metal back 8 of a thin Al film was formed to a thickness of 50 nm on the fluorescent film 7 by sputtering and, subsequently, a getter film 9 of an Ti—Al alloy was formed to a thickness of 50 nm on the metal back B. The target used for the sputtering operation was made of an alloy containing Ti by 85% and Al by 15%. Thereafter, the inside of the vacuum chamber of the sputtering apparatus was filled with nitrogen gas and a nitride layer was formed on the surface of the getter film 9.

Step j:

Subsequently, an envelope having a configuration as shown in FIG. 1 was prepared in a following manner.

After rigidly securing the electron source substrate 1 to the rear plate 2, they were assembled with a support frame 3 and the face plate 4 to form an envelope 5 and the lower wires 82 and the upper wires 83 of the electron source substrate 1 were respectively connected to the external terminals 10 and 11. The electron source substrate 1 and the face plate 4 were rigorously aligned and the envelope 5 was hermetically sealed by applying frit glass to the junctions, baking the envelope 5 to 300° C. in the atmosphere and heat-treating the combined members at 400° C. for 10 minutes in Ar gas. The electron source substrate 1 was secured to the rear plate 2 in a similar manner.

Before describing the subsequent steps, the vacuum treatment system used for them will be described by referring to FIG. 6.

The image-forming apparatus 41 is connected to a vacuum container 43 by way of an exhaust pipe 42. The vacuum container 43 is by turn connected to an vacuum pumping unit 45 by way of a gate valve 44. The vacuum container 43 is provided with a pressure gauge 46 and a quadrupole mass (Q-mass) spectrometer 47 to monitor the internal pressure and the partial pressures of the gases remaining in the inside. Since it is difficult to directly measure the internal pressure of the envelope and the partial pressures of the gases contained in the envelope, those of the vacuum container 43 are gauged and used for those of the envelope. The vacuum pumping unit 45 comprises a sorption pump and an ion pump to produce ultrahigh vacuum. The vacuum container 43 is connected to a plurality of gas feeding apparatuses and a gaseous substance contained in a substance source 49 can be fed into the container. The substance to be fed is filled in a bomb or an ampule depending on the type and the rate at which it is fed can be controlled by means of a gas feed rate control means 48. The gas feed rate control means may be a needle valve, a mass flow controller or some other means depending on the substance to be fed, the flow rate and the precision required for controlling the feed rate. In this example, the substance source was a glass ampule containing acetone $(CH_3)_2CO$ and the gas feed rate control means was a slow leak valve.

The following steps were carried out with a vacuum treatment system having a configuration as described above.

Step k:

After evacuating the inside of the envelope 5 to a reading of the pressure gauge 86 less than $1\times10^{-3}$ Pa, an energization forming operation was carried out on the plurality of electroconductive films for forming electron-emitting regions (2 in FIG. 17H) arranged on the electron source substrate 1.

Figure 7:
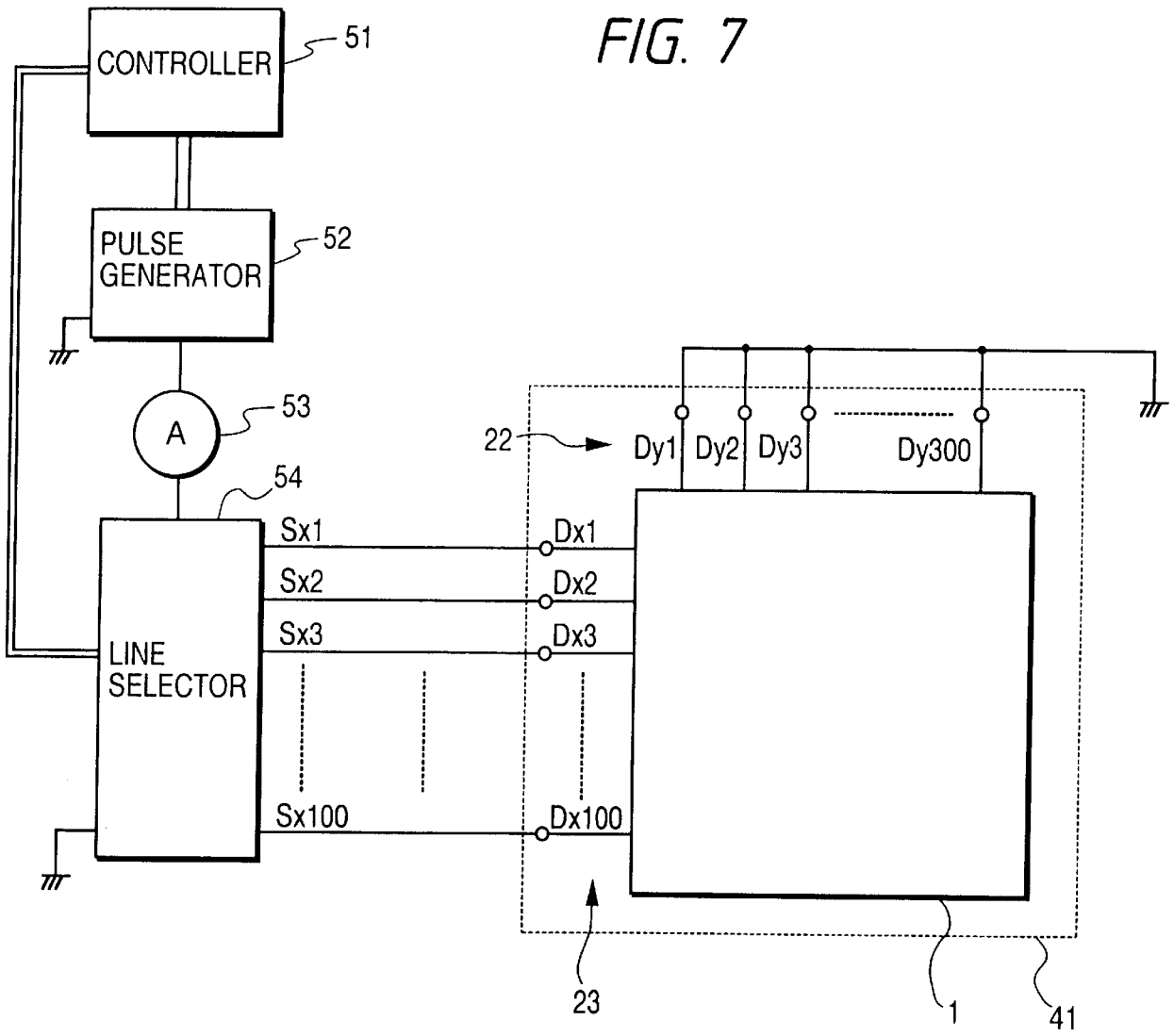
FIG. 7 is a schematic circuit diagram of a circuit to be used for energization forming and activation steps in manufacturing an image-forming apparatus according to the invention.

As shown in FIG. 7, the Y-directional wires were commonly connected and grounded. In FIG. 7, 51 is a control unit for controlling a pulse generator 52 and a line selection unit 54. 53 denotes an ammeter. A single line was selected out of the X-directional wires 22 and a pulse voltage was applied to it. The energization forming was carried out on the devices along the X-direction on a row by row (300 devices) basis. The waveform of the applied pulse voltage was a triangular pulse with an gradually increasing wave height. The pulse width of T1=1 msec and the pulse interval of T2=10 msec were used. An extra pulse voltage of 0.1V was inserted into intervals of the forming pulse voltage in order to determine the resistance of each row of devices and the energization forming process was terminated for the row when the resistance exceeded 3.3 kΩ (1 MΩ per device). In this way, all the rows and therefore all the electroconductive films (for forming electron-emitting regions) were subjected to energization forming to produce electron-emitting regions. Consequently, an electron source comprising a plurality of surface conduction electron-emitting devices with a simple matrix wiring was prepared.

Step: 1

Subsequently, the electron source was subjected to an activation process, introducing acetone $(CH_3)_2CO$ and hydrogen $H_2$ into the vacuum chamber 43 and maintaining the partial pressure of acetone $(CH_3)_2CO$ and hydrogen $H_2$ respectively to $1.3\times10^{-3}$ Pa and $1.3\times10^{-2}$. A pulse voltage was then applied to the electron source to activate each of the electron-emitting devices, observing If. A rectangular pulse voltage having a pulse width of T1=100 μsec and a pulse interval of T2=167 μsec was generated by the pulse generator 52. The wave height of the pulse voltage was 14V. The lines D×1 through D×100 were sequentially selected on a line by line basis by every 167 μsec by means of the line selection unit 54 so that a rectangular pulse voltage with T1=100 μsec and T2=16.7 msec was applied to the devices of each line with a gradually shifted phase.

The ammeter 53 was used in a mode of operation for detecting the average electric current level when the rectangular pulse was on (and the voltage as equal to 14V) and the activation process was terminated when the current level got to 600 mA (2 mA for each device). Then the inside of the envelope was evacuated.

Step m:

The image-forming apparatus and the vacuum container were entirely heated by a heating apparatus (not shown) and held to 250° C. for 24 hours, evacuating the inside continuously. As a result of this process, $(CH_3)_2CO$ and its decomposition products that might have been adsorbed by the inner walls of the envelope and the vacuum container were removed. This was confirmed by means of the Q-mass 47.

Step n:

Subsequently, the image-forming apparatus was subjected to an operation of getter activation. This was done by irradiating the getter layer on the metal back with electron beams produced from the electron source of the image-forming apparatus.

The electron source was driven to operate as in Step 1 above on a line by line basis to cause the electron-emitting devices to emit electrons at a frequency of 60 Hz. First, the voltage applied between the electron source and the high voltage terminal Hv, connected with the metal back, was Va=4 kV. The image-forming apparatus of this example was so regulated that electron beams hit the respective pixels when voltages of Va=5 kV and Vf=15V (device voltage) were used. Since each electron emitted from the surface conduction electron-emitting devices shows a momentum having a component running along the surface of the electron source substrate 1 of the image-forming apparatus, it arrives a position on the image-forming member displaced from the target pixel. After this operation was conducted for 3 hours, the above voltage was made to shift repeatedly between 4 kV and 5 kV. While the rate of voltage shift was 50V/min in this example, a different rate might well be used if it were not too high.

The above operation was continued for 5 hours to complete the getter activation.

Note that the getter operates mainly in areas other than those of the pixels during the image display operation of the apparatus and, therefore, such areas were activated in the first instance. Thereafter, the voltage applied to the high voltage terminal was gradually changed to shifts the targets of electron beams until the entire getter film was activated. Since the face plate was irradiated with highly energized electron beams during the above process, gas was produced to some extent from the fluorescent bodies and other components. However, the gas was absorbed by areas where the operation of getter activation had been conducted in the areas on the black stripes with a relatively low energy consumption level, the electron source was not adversely affected for its performance.

Thereafter, voltage Va was raised to a level of Va=6 kV to cause the fluorescent bodies to discharge gas. Since the image-forming apparatus of this example was designed to operate with a voltage level of Va=5 kV, they would not discharge gas significantly during the actual operation after such preliminary gas discharge due to a high voltage.

Since each electron emitted from the surface conduction electron-emitting devices of the image-forming apparatus of this example showed a momentum having a component directed from the lower potential side toward the higher potential side of the device (referred to as "laterally directed" for the sake of convenience), the electron hit the face plate at a location slightly and laterally displaced from the spot directly above the electron-emitting device. If the displacement is Δ, it was proved that the following approximate holds true.

$$\Delta x \propto \sqrt{\frac{Vf}{Va}}$$

Thus, the above operation of raising Va to 6 kV was conducted, maintaining the ratio of Vf/Va to a constant level. For example, when Va=6 kV, Vf=18V was selected.

Step o:

After confirming that the internal pressure fell to less than $1.3\times10^{-5}$ Pa, the exhaust pipe was heated and sealed off by means of a gas burner. Thereafter, the evaporation type getter arranged out of the image display region was made to flash by heating it with a high frequency wave.

Now, the image-forming apparatus of this example was completed.

Example 2

An image-forming apparatus was prepared for this example like the apparatus of Example 1 except that the Ti—Al getter film 9 was made to have a film thickness of 30 nm.

Example 3

An image-forming apparatus was prepared for this example like the apparatus of Example 1 except that the Ti—Al getter film 9 was made to have a film thickness of 20 nm.

Example 4

An image-forming apparatus was prepared for this example like the apparatus of Example 1 except that the Ti—Al getter film 9 was made to have a film thickness of 100 nm.

Example 5

In this example, an image-forming apparatus comprising a metal back made of a getter film was prepared.

Firstly, the steps up to Step j were of Example 1 were followed except that the metal back was made of a thin film of a non-evaporation type gettering substance, which thin film was formed to a thickness of 50 nm by sputtering, using an alloy of Zr;75%, V;20% and Fe;5% for the target.

A high vacuum pumping unit comprising a rotary pump and a turbo pump was used to evacuate the vacuum apparatus to a pressure level of less than $1.3\times10^{-4}$ Pa for energization forming in Step k as in the case of Example 1. A pulse exactly same as that of Step 1 of Example 1 was used for activation. No gas was fed into the vacuum container but the organic substances dispersed from the vacuum pumping unit and slightly remaining in the vacuum container were used to deposit carbon for the operation of activation. The pressure in the vacuum container in this step was about $2.7\times10^{-3}$ Pa.

After the activation step, a voltage of 16V was used to see the device current If and the emission current Ie and obtained averages values of If=2.2 mA and Ie=2.2 $\mu$A for each device.

Subsequently, a heater was placed outside the envelope and close to the face plate to heat the latter to about 300° C. for getter activation.

Then, the exhaust pipe was heated and sealed off by means of a burner as in the case of Step o of Example 1 and the evaporation type getter was made to flash to complete an image-forming apparatus of this example.

Example 6

An image-forming apparatus was prepared for this example like the apparatus of Example 5 except that the getter film operating also as a metal back was made to have a film thickness of 70 nm.

Example 7

An image-forming apparatus was prepared for this example like the apparatus of Example 5 except that the getter film operating also as a metal back was made to have a film thickness of 100 nm.

Example 8

An image-forming apparatus was prepared for this example like the apparatus of Example 5 except that the getter film operating also as a metal back was made to have a film thickness of 20 nm.

Example 9

The image-forming apparatus of this example resembles to that of Example 1, although a getter film was patterned to show stripes on the metal back of the face plate and the stripes were located on the respective stripe-shaped black electroconductive bodies 12 with the metal back interposed therebetween. The getter layer was formed in a manner as described below.

A metal back 8 of an Al thin film was formed on a fluorescent film as shown in FIG. 2A to a thickness of 50 nm by sputtering. After taking out the face plate from the sputtering apparatus, a mask having stripe-shaped openings was placed thereon to form a getter film. The mask and the face plate was precisely aligned in such a way that the openings of the mask were exactly aligned with the respective stripes of the black electroconductive bodies 12 of the fluorescent film. The mask was secured in position without making it directly contact with the face plate so that the fluorescent film might not be damaged. The assemble was then put into a sputtering apparatus again and a getter film 9 of Zr—V—Fe was formed thereon to a thickness of 300 nm. A sputtering target similar to that of Example 6 was used for forming a gettering substance layer. Thereafter, the vacuum chamber of the sputtering apparatus was filled with nitrogen gas and a nitride layer was formed on the surface of the getter film.

After completing the remaining steps same as those of Example 1, an image-forming apparatus of this Example was produced.

Example 10

The image-forming apparatus of this example comprised an electron source having a configuration schematically shown in FIGS. 3A and 3B. Now, the method of manufacturing the apparatus will be described by referring to FIGS. 9A through 9I. Note that FIGS. 9A through 9E show cross sectional views taken along line 3B—3B of FIG. 3A.

Figure 9A:
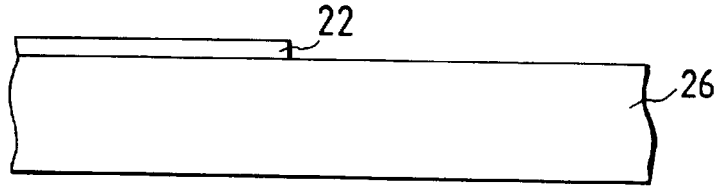
FIGS. 9A through 9I are schematic sectional views of an electron-emitting device of Example 6 in different manufacturing steps.

Step A:

After thoroughly cleansing a soda lime glass plate, a silicon oxide film was formed thereon to a thickness of 0.5 $\mu$m by sputtering to produce a substrate 1, on which Cr and Au were sequentially laid to thicknesses of 50 angstroms and 6,000 angstroms respectively and then photoresist (AZ1370: available from Hoechst Corporation) was applied thereto by means of a spinner, while rotating the film, and baked. Thereafter, a photo-mask image was exposed to light and developed to produce a resist pattern for Y-directional wires 82 and then the deposited Au/Cr film was wet-etched to produce Y-directional wires (lower wires) 22 having an intended profile (FIG. 9A).

Figure 9B:
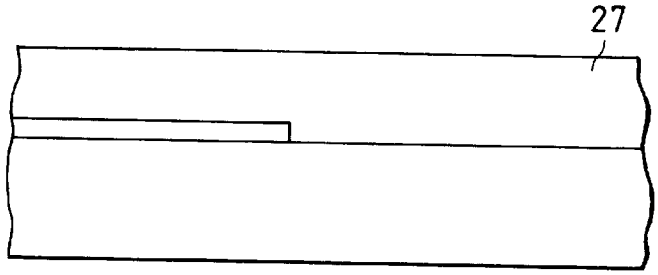

Step B:

A silicon oxide film was formed as an interlayer insulation layer 27 to a thickness of 1.0 $\mu$m by RF sputtering (FIG. 9B).

Figure 9C:
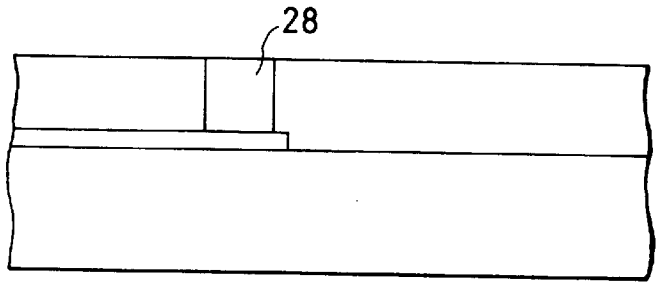

Step C:

A photoresist pattern was prepared for producing a contact hole in the silicon oxide film deposited in Step B, which contact hole 28 was then actually formed by etching the interlayer insulation layer 27, using the photoresist pattern for a mask. A technique of RIE (Reactive Ion Etching) using $CF_4$ and $H_2$ gas was employed for the etching operation (FIG. 9C).

Figure 9D:
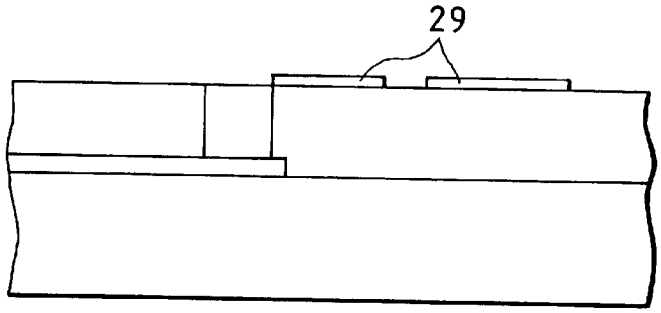

Step D:

Thereafter, a pattern of photoresist (RD-2000N-41: available from Hitachi Chemical Co., Ltd.) was formed for a pair of device electrodes 29 and a gap G separating the pair of electrodes and then Ti and Pt were sequentially deposited thereon respectively to thicknesses of 5 nm and 100 nm by vacuum deposition for each surface conduction electron-emitting device. The photoresist pattern was dissolved by an organic solvent and the Pt/Ti deposit film was treated by using a lift-off technique to produce a pair of device electrodes 29 having a width of 300 $\mu$m and separated from each other by a distance of 3 $\mu$m for each electron-emitting device (FIG. 9D).

Figure 9E:
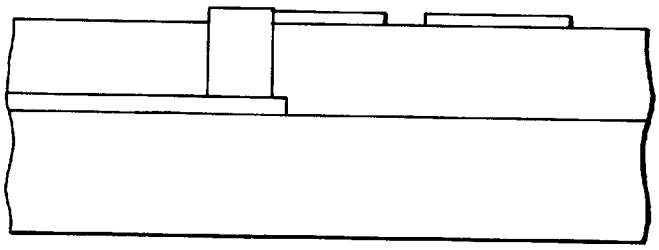

Step E:

After covering the entire surface with a photoresist mask except the contact holes, Au was deposited to a thickness of 500 $\mu$m by vacuum deposition and then the photoresist was removed by an organic solvent. Thereafter, any unnecessary areas of the Au vapor deposition film was removed by means of a lift-off technique to bury the contact holes 28 (FIG. 9E).

Figure 9F:
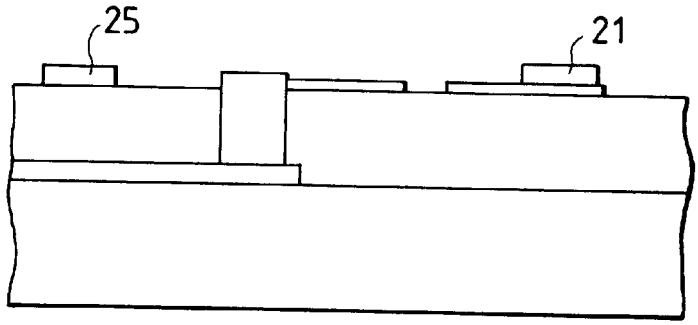

Step F:

After forming a photoresist pattern for upper wires 21 and wires 25 for getter activation, Ti and Au were sequentially deposited to respective thicknesses of 5 nm and 500 nm by vacuum deposition. Any unnecessary areas were removed by a lift-off technique to produce X-directional wires (upper wires) 21 and wires 25 for getter activation having desired respective profiles (FIG. 9F).

Figure 9G:
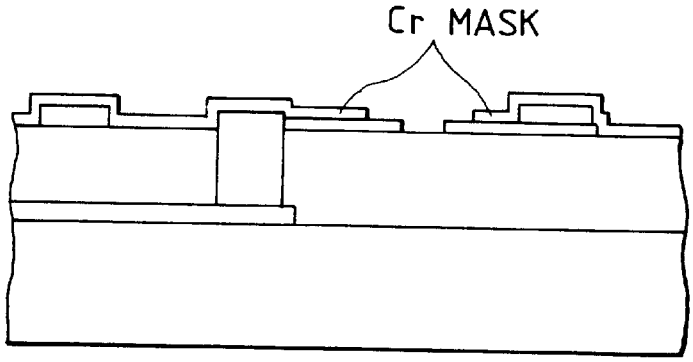

Step G:

A Cr film was formed to a film thickness of 50 nm by vacuum deposition and a photoresist layer was formed thereon and then, using a photomask, it was exposed to light and photochemically developed to produce a resist mask having openings corresponding to those of the electroconductive films. The openings were actually formed as in the case of the Cr film by wet etching and the photoresist was removed to produce a Cr mask (FIG. 9G).

Figure 9H:
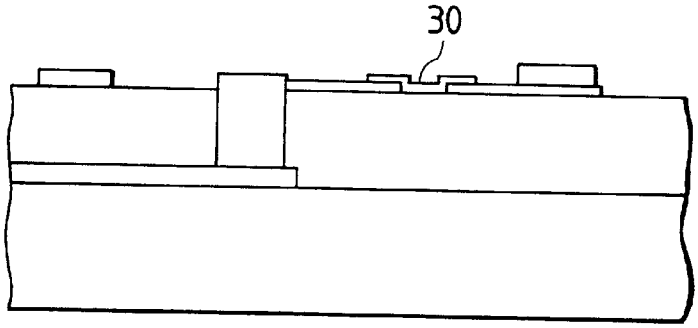

Step H:

A Pd amine complex solution (ccp4230: available from Okuno Pharmaceutical Co., Ltd.) was applied to the Cr film by means of a spinner, while rotating the film, and baked at 300 C for 12 minutes in the atmosphere to produce a film of fine particles containing PdO as a principal ingredient. Then, the Cr mask was removed by dipping it into an etchant and electroconductive films 30 made of PdO fine particles and having desired profiles were produced by a lift-off technique (FIG. 9H).

Figure 9I:
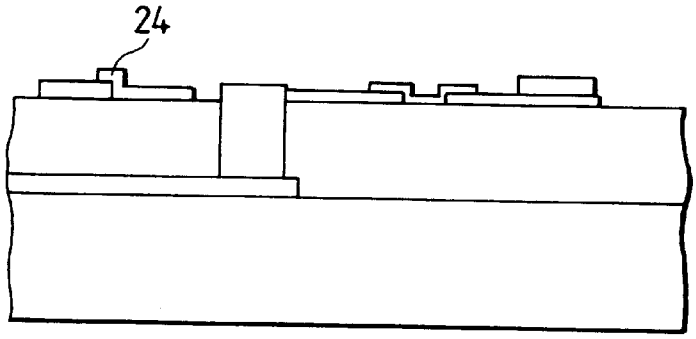

Step I:

A metal mask having openings corresponding to the shapes of the getter film to be produced was placed on the electron source substrate and they were rigorously aligned and secured relative to each other. They were then put into a sputtering apparatus and a getter layer 24 of an alloy of Zr—V—Fe was formed by sputtering. The thickness of the getter layer was controlled to show a value of 300 nm. The sputtering target had a composition of Zr;70%, V;25% and Fe;5% (by weight). After the layer was formed, nitrogen gas $N_2$ was immediately introduced in the sputtering apparatus to form a nitride layer on the surface of the getter layer (FIG. 9I).

Step J:

The electron source substrate was assembled with a face plate, a support frame and a rear plate as in the case of Example 1 and bonded to each other with frit glass to produce an image-forming apparatus. While the face plate might well be same as that of Example 1, that of this example did not carry a getter layer on the Al metal back (thickness of 100 nm).

Figure 6:
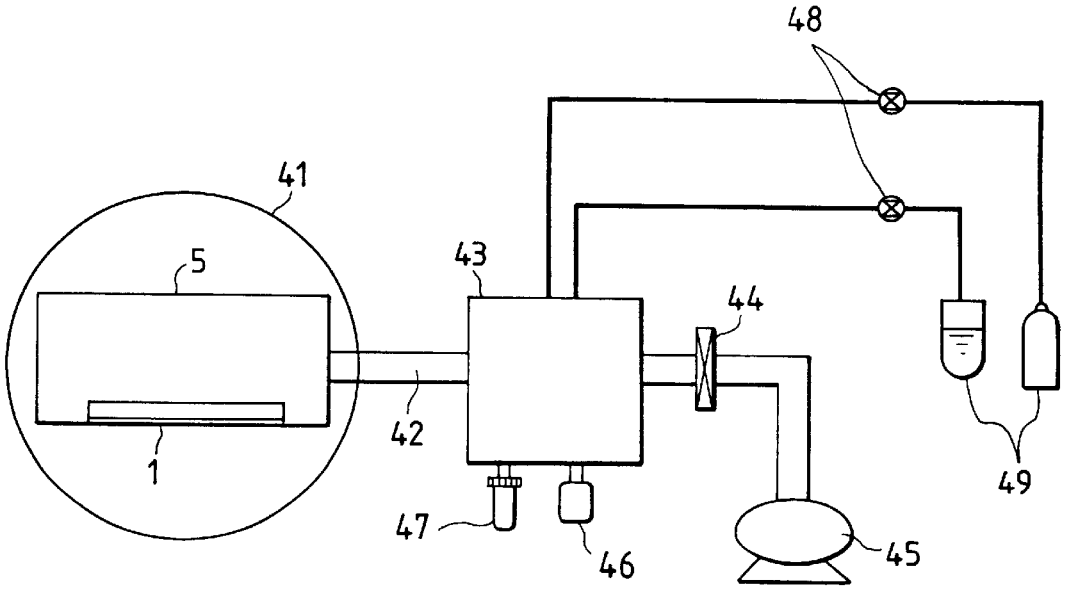
FIG. 6 is a schematic block diagram of a vacuum system to be used for manufacturing an image-forming apparatus according to the invention.

Step K:

The image-forming apparatus assembled in the preceding step was subjected to energization forming and activation of surface conduction electron-emitting devices as in the case of Example 1 by means of apparatuses shown in FIGS. 6 and 7.

Step L:

The inside of the envelope was then cleaned in a manner as described in Step m of Example 1.

Step M:

A pulse voltage similar to the one used for activation of an electron source (as described in Step 1, Example 1) was applied to cause the electron-emitting devices 23 to emit electron beams. A voltage of −1 kV was applied to the high voltage terminal Hv, while a voltage of +50V was applied to the getter activation wires. Electrons emitted from the electron-emitting devices 23 were attracted to the getter layer 24 and collided with it to activate the getter.

Step N:

After ensuring that the internal pressure was less than $1.3\times10^{-5}$ Pa, the exhaust pipe was heated and sealed off and the evaporation type getter arranged outside the image display region was heated by high frequency heating to cause it to flash. Now the image-forming apparatus of this Example was completed.

Example 11

Figure 10:
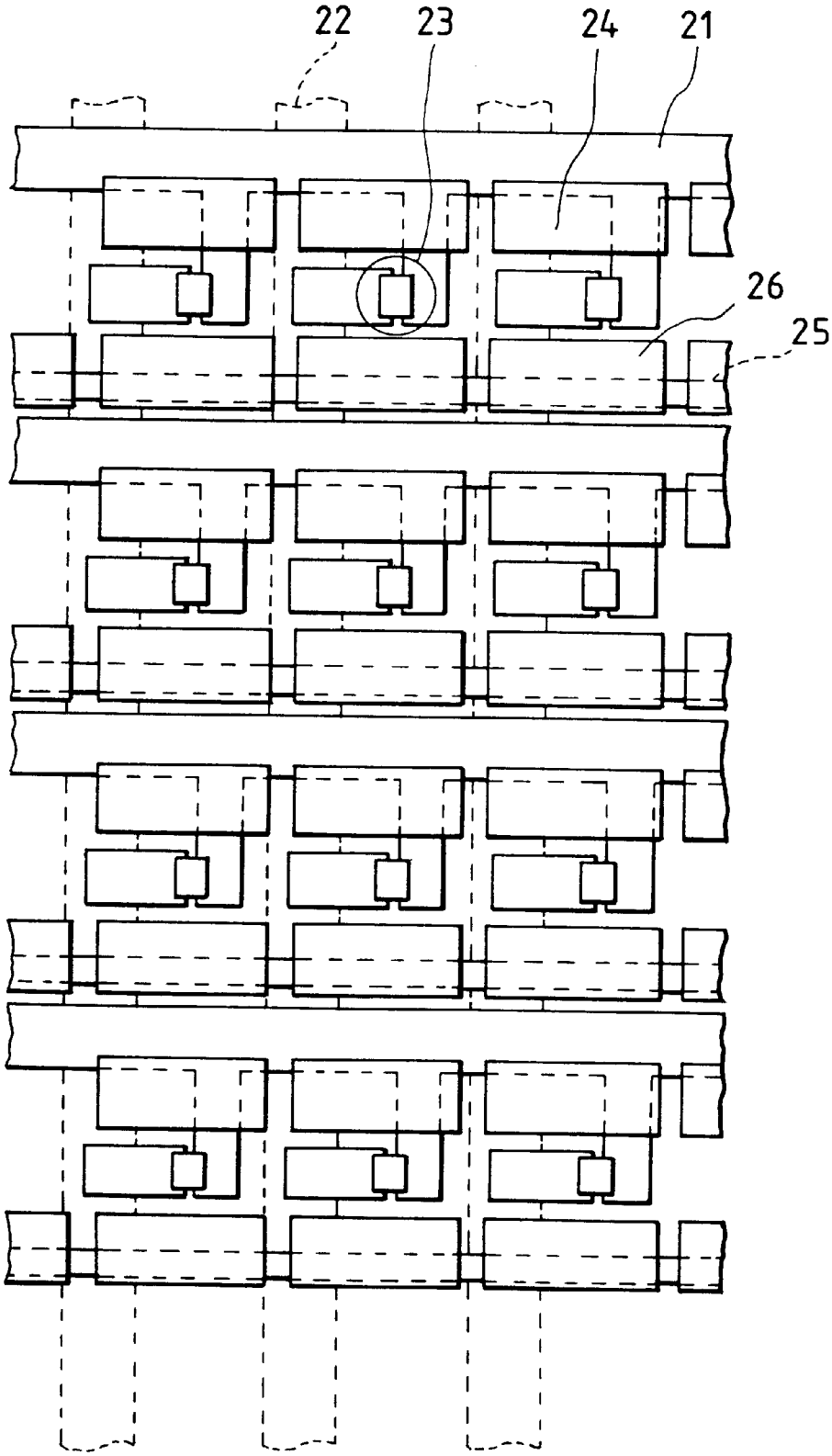
FIG. 10 is a schematic partial plan view of the image-forming apparatus of Example 7.

Although the image-forming apparatus prepared in this Example had, in principle, a configuration as schematically illustrated in FIG. 4, the getter layers of this example were actually arranged in a manner as indicated by reference numerals 24, 26 in FIG. 10 in order to simply the manufacturing process. The steps of Example 10 above were followed for the image-forming apparatus of this example except those as will be described below.

The steps up to Step H were same as their counterparts of Example 10.

Step I:

A metal mask having openings corresponding to the shapes of the getter layers 24, 26 of FIG. 10 was used and the getter layers were formed to a thickness of 300 nm.

Steps J through M of Example 10 were also followed but only the getter layers 24 were activated in Step M.

Step M':

The getter layers 26 were activated as in Step M except that a voltage of −50V was applied to the getter activation wires. As −50V was applied to the getter activation wires, electron beams emitted from the electron-emitting devices were made to collide with and activate the getter layers 26 electrically connected to the respective X-directional wires 21 that operated as the higher potential side wires of the electron source. The voltage of −50V was applied to the getter activation wires and the getter layers 24 connected thereto in order to impart repellent force to electrons heading to the getter layers 24 and consequently increase the number of electrons colliding with the getter layers 26.

Finally, Step N of Example 10 was followed to produce a complete image-forming apparatus for this example.

Comparative Example 1

An image-forming apparatus similar to that of Example 1 was prepared except that the apparatus of this comparative example did not have a getter film 9 of FIG. 1 and the metal back comprising Al was made as thick as 100 nm. Otherwise, the image-forming apparatus of this comparative example had a configuration same as that of the apparatus of Example 1 and was prepared in a similar manner.

Figure 8:
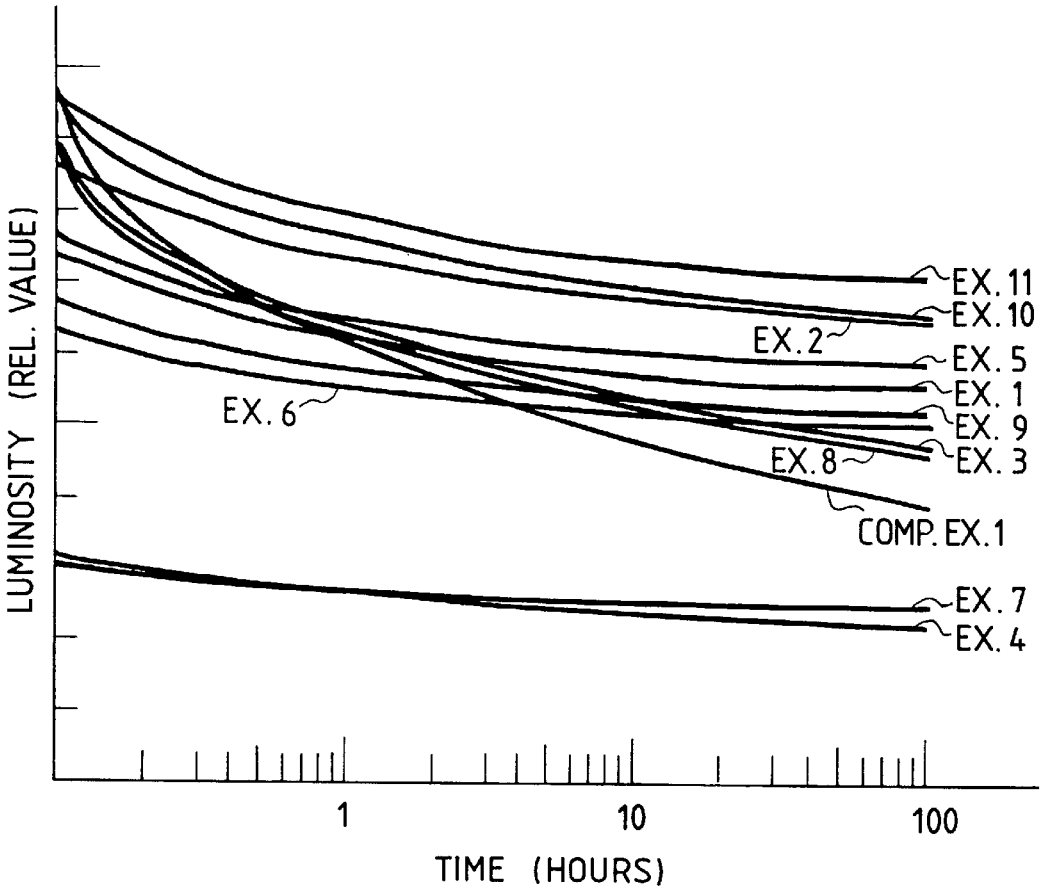
FIG. 8 is a graph showing the performances of the electron-emitting devices prepared in the examples and comparative examples that will be described hereinafter.

The image-forming apparatuses of Examples 1 through 11 and Comparative Example 1 were tested for comparison by driving them to operate by way of the respective simple matrix wiring to cause the image-forming apparatuses to continuously fluoresce. The change with time of the brightness of each apparatus was measured. While the brightness of the display screen decreases as it continues to fluoresce, different. areas of the display screen behave differently relative to each other to a large extent. While the center of the image display region reduces its brightness remarkably, the peripheral areas do not lose the original brightness easily. FIG. 8 shows the changes of brightness with time of an area near the intersection of Dx50 and Dy150 of the various apparatuses prepared in the examples detected by means of a photosensor.

If it is possible to bake an image-forming apparatus enough for de-gas treatment, generation of gas will be suppressed. In some cases, however, it is not posible.

This is because electron emission devices and other members of an image-forming apparatus are easily damaged by heat treatment. In those cases, generation of gas can take place.

The image-forming apparatus of Comparative Example 1 lost remarkably with time the original level of emission current of the devices located at the intersections of Dx50 and Dy149, Dy150 and Dy151. Obviously this seriously affected the brightness reduction of those apparatuses. Therefore, this phenomenon may be attributable not to the degradation of the fluorescent bodies but that of the performance of the electron source. The reason why the center of the image display region lost it brightness remarkably may be that the evaporation type getter was located only outside the image display region and the pressure of the discharged gas was inevitably high at the center to deteriorate the performance of the electron-emitting devices located there.

To the contrary, the gettering substance was arranged throughout the image display region of the apparatus of each of Examples 1 through 11 to reduce the adverse effect of discharged gas.

Example 12

Figure 11A:
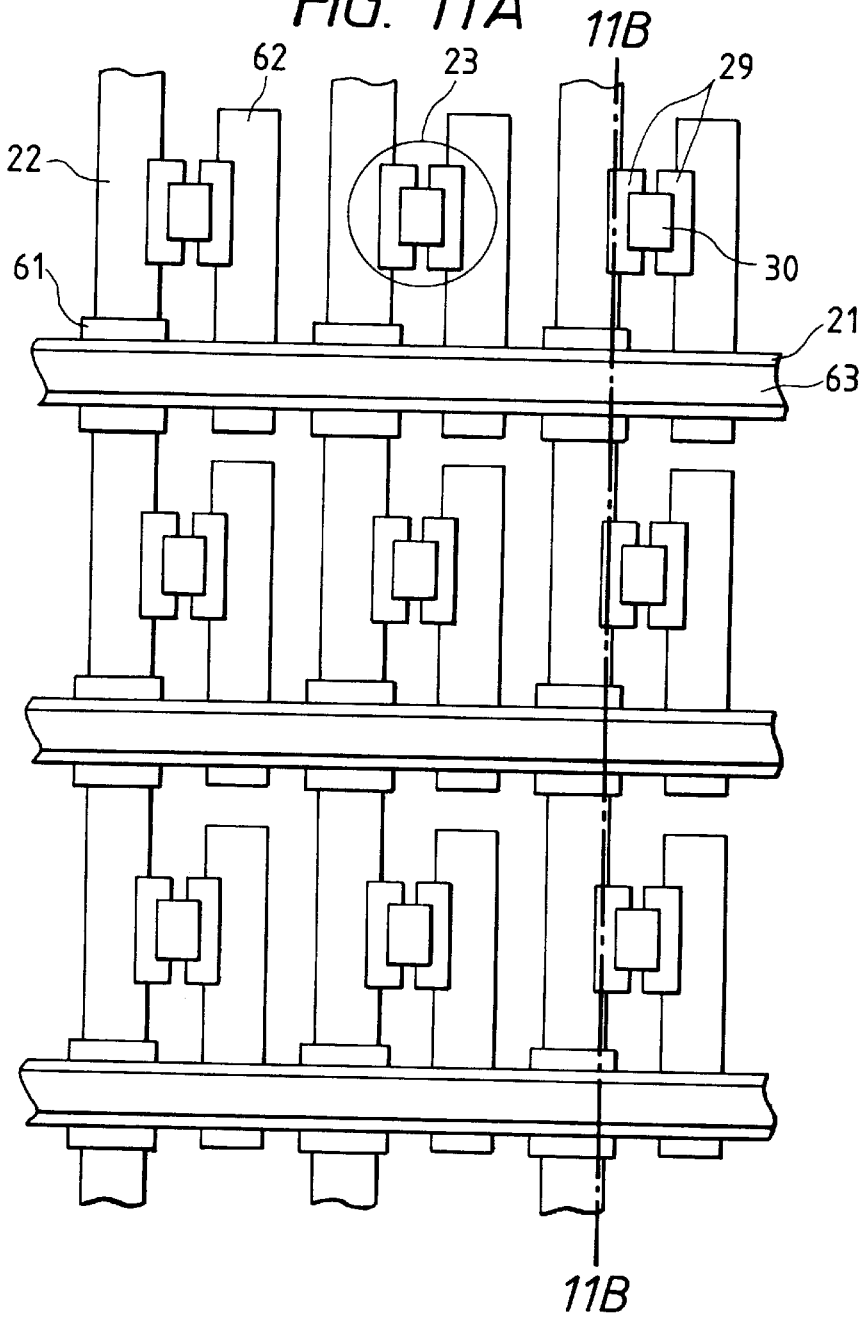
FIGS. 11A and 11B are schematic partial views of the image-forming apparatus of Example 8.
Figure 11B:
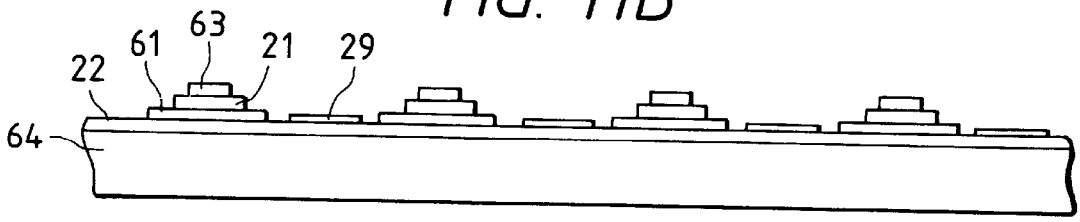

In this example, an image-forming apparatus comprising an electron source as illustrated in FIGS. 11A and 11B was prepared. FIG. 11A is a schematic plan view, while FIG. 11B is a schematic cross sectional view taken along line 11B—11B in FIG. 11A. An interlayer insulation layer 61 was arranged at each intersection of the X-directional (upper) wires 21 and the Y-directional (lower) wires 22. Reference numeral 62 denotes a wiring pad for connecting each of the surface conduction electron-emitting devices 23 and the related upper wire.

The electron source was formed directly on a rear plate 64, which was a soda lime glass plate as large as 240 mm×320 mm. The upper wires 21 had a width of 500 μm and a height of 12 μm, whereas the upper wires 22 and the wiring pads 62 had a width of 300 μm and a height of 8 μm. They were formed by printing and baking Ag paste ink. The interlayer insulation layers 61 were formed by printing and baking glass paste and showed a height of 20 μm. There were provided a total of 100 upper wires and 200 lower wires. Upper wire drawing out electrodes and lower wire drawing out electrodes having a width of 600 μm and a height of 2 μm were also provided, electrically connected to the respective upper and lower wires and made to extend to the related ends of the rear plate.

The device electrodes 65, 66 of each electron-emitting device were formed by vapor deposition of Pt to a film thickness of 100 nm. The electrodes were separated by a gap of L=2 μm and had a width of W=300 μm. The electroconductive thin film of each electron-emitting device was made of PdO fine particles and prepared as in the case of the preceding examples.

The face plate was prepared by applying a green fluorescent material of P-22 to a surface of a soda lime glass as large as 190 mm×270 mm, subjecting it to a smoothing process (normally referred to as "filming") and then forming an Al thin film for a metal back by vacuum deposition to a thickness of 200 nm. Note that wires had been formed in advance by printing and baking Ag paste in order to electrically connect the metal back to a high voltage terminal.

The support frame was made of a soda lime glass plate having a thickness of 6 mm, outer dimensions of 150 mm×230 mm and a width of 10 nm, to which a soda lime glass pipe having an outer diameter of 6 mm and an inner diameter of 4 mm was securely fitted.

Figure 12:
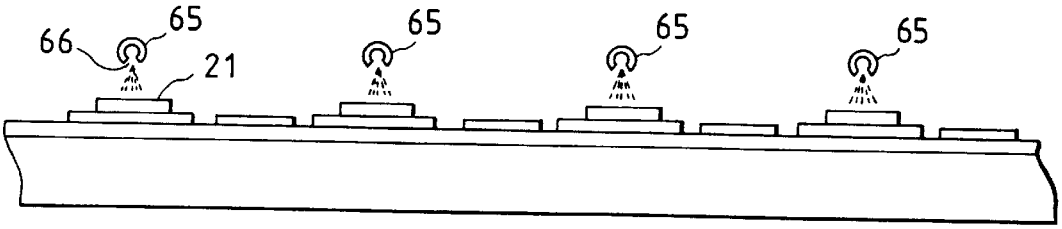
FIG. 12 is a schematic partial sectional view of the image-forming apparatus of Example 8, illustrating the method of manufacturing the same.

The rear plate, the face plate and the support frame were bonded together by means of frit glass (LS-7105: available from Japan Electric Glass Co., Ltd.). Wires of a gettering substance 65 were also arranged directly above the respective upper wires at this stage in a manner as shown in FIG. 12. Each of the getter wires comprises a Ba—Al alloy along the central axis and was provided with an axial groove 66 that was made to face downward and held in engagement with a related one of the upper wires 21.

Thereafter, Steps k through m of Example 1 were followed. During the operation of energization forming, the internal pressure of the envelope was held to $1.3\times10^{-3}$ Pa and a triangular pulse with a pulse width of T1=1 msec, a pulse interval of T2=10 msec and a pulse wave height of 5V was applied for 60 seconds.

After the energization forming and the activation, the envelope was sufficiently evacuated and the wire getters were made to flash to form a getter layer 63 on each of the upper wires 21.

Subsequently, the exhaust pipe was sealed off to produce a complete image-forming apparatus of this example.

Note that the X-directional wires 21 had a width greater than those of the Y-directional wires 22 and the wiring pads 62. This was because a single one of the X-directional wires is selected and fed with an electric current for simple matrix driving and the electric current is then made to flow into selected ones of the Y-directional wires according to an input signal so that each of the X-directional wires are required to show a current capacity greater than that of each of the Y-directional wires and the wiring pads. Therefore, a sufficient area was provided on each of the X-directional wires to accommodate a layer of a gettering substance 63 thereon.

Example 13

Lateral type field emission electron-emitting device were used for the electron source of the image-forming apparatus of this example. The electron source substrate had a basic configuration same as that of the substrate of Example 5, although each of the electron-emitting devices had a configuration as schematically shown in FIG. 13.

Figure 13:
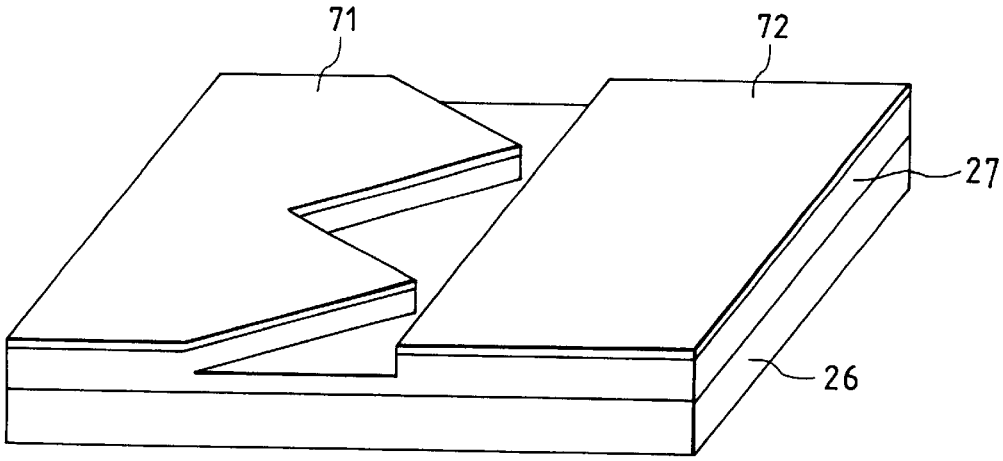
FIG. 13 is a schematic perspective view of an electron-emitting device of Example 9, illustrating the profile of the electron-emitting region and its vicinity.
Figure 14A:
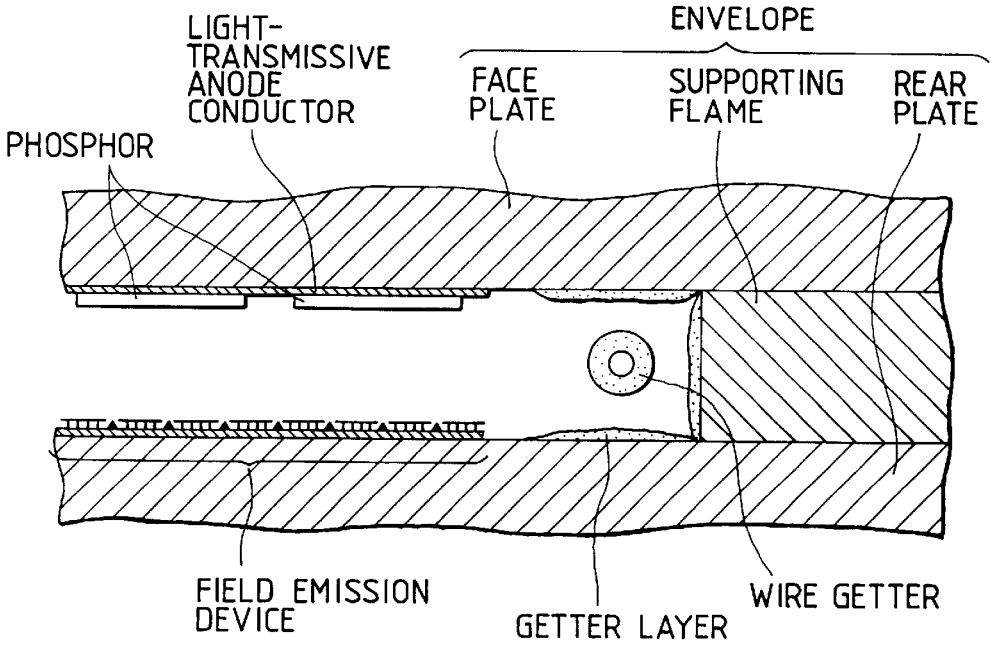
FIGS. 14A and 14B are schematic partial views of a conventional flat panel display.
Figure 14B:
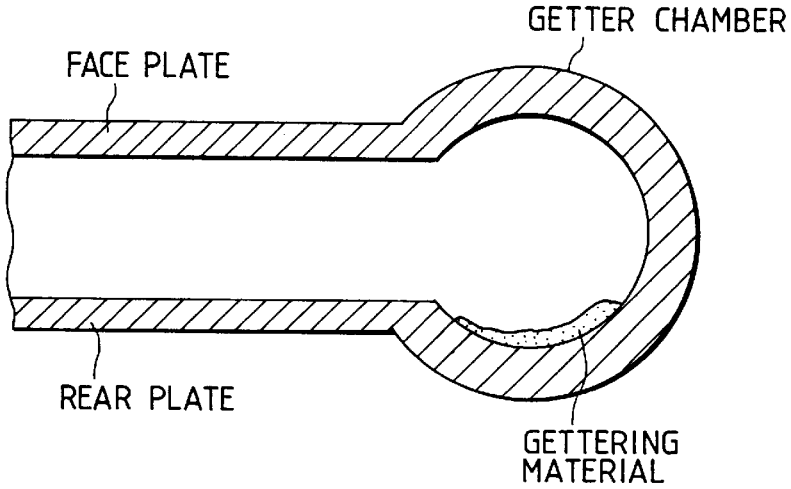

Referring to FIG. 13, an emitter 71 and a gate 72 were formed on a substrate 26 with an insulation layer 27 interposed therebetween. Both the emitter 71 and the gate 72 were made of a Pt thin film having a thickness of 0.3 μm. The tips of the emitter 71 provided an electron-emitting region and had an angle of 45.

The image-forming apparatus of this examples was prepared like that of Example 10, although the Pt films was formed by sputtering to a thickness of 0.3 μm after the steps of FIGS. 9A and 9B. Then, resist was applied thereto and baked to form a resist layer, which was then exposed to light and photochemically developed, using a photomask, to produce a resist pattern having a profile corresponding to those of the emitter 71 and the gate 72. Thereafter, the emitter and the gate were actually formed by dry etching and the resist was removed to produce the emitter and the gate having their respective predetermined profiles on the substrate as illustrated in FIG. 13.

Subsequently, the steps of FIGS. 9C through 9F were followed to produce a complete electron source substrate carrying thereon a number of electron-emitting devices, each comprising an emitter and a gate.

Then, an image-forming apparatus was prepared, using the electron source substrate and substantially following the steps of Example 10, except that, unlike surface conduction electron-emitting devices, the field emission electron-emitting devices did not require energization forming. A pulse voltage having a wave height of 100V was used to drive the apparatus, while a voltage of 140V was applied to the getter activation electrodes for the operation of getter activation.

Comparative Example 2

An image-forming apparatus similar to that of Example 13 was prepared but not subjected to a process of getter activation.

The image-forming apparatus of Example 13 and that of Comparative Example 2 were compared in a manner as described earlier. While the former operated stably for a long time, the latter gradually lost the brightness at the center of the image display region.

As described above, an image-forming apparatus according to the invention can effectively maintain the original brightness without deterioration particularly at the center of the image display region if compared with any comparable conventional apparatuses even when it is drive to operate for a long time.

While the basic idea of the present invention can be effectively applied to an image-forming apparatus having no electrodes such as control electrodes between the electron source and the face plate, an image-forming apparatus comprising such control electrodes will operates well if it is realized on the basic idea of the present invention.

What is claimed is:

1. An image-forming apparatus comprising:

an electron source and an image-forming member disposed in an envelope, wherein said electron source includes a plurality of electron-emitting devices, each of said electron-emitting devices comprising a higher potential electrode, an electron-emitting region and a lower potential electrode arranged side by side on a substrate, and said image forming member is disposed opposite to said substrate, and wherein a gettering substance is provided as electrically connected to wires provided for activating said gettering substance, said wires being at a higher electric potential than said higher potential electrodes.

2. An image forming apparatus comprising:

an electron source and an image-forming member disposed in an envelope, wherein said electron source includes a plurality of electron-emitting devices, each of said electron-emitting devices comprising a higher potential electrode, an electron-emitting region and a lower potential electrode arranged side by side on a substrate, and said image-forming member is disposed opposite to said substrate, and wherein a gettering substance is provided electrically connected to wires for applying a voltage to said higher potential electrodes of said electron-emitting devices.

3. An image forming apparatus according to claim 2 or 1, wherein said gettering substance is an alloy containing at least one of Zr and Ba as a principal ingredient.

4. An image forming apparatus according to claim 2 or 1, wherein said electron source comprises a plurality of electron-emitting devices arranged on a substrate and wired to form a simple matrix arrangement.

5. An image forming apparatus according to claim 2 or 1, wherein said electron source comprises surface conduction electron-emitting devices.

6. An image forming apparatus according to claim 2 or 1, wherein said electron source comprises lateral type field emission electron-emitting devices.

7. An image forming apparatus according to claim 2 or 1, wherein said gettering substance is a non-evaporation type gettering substance.

8. An image-forming apparatus comprising a plurality of electron-emitting devices, a wire connecting said plurality of electron-emitting devices, and an image-forming member, wherein a getter layer is provided on said wire.

9. An image-forming apparatus comprising a plurality of electron-emitting devices, a plurality of row-directional wires, a plurality of column-directional wires and an image-forming member, said plurality of electron-emitting devices being connected to said plurality of row- and column-directional wires to form a matrix wiring, wherein a getter layer is provided on at least one of said row- and column-directional wires.

10. An image-forming apparatus according to claim 9, wherein said getter layer is provided on one of said row- and column-directional wires which are disposed above the other at intersections.

11. An image-forming apparatus according to claim 9, wherein said getter layer is provided on one of said row- and column-directional wires to which a scanning device is applied.

* * * * *

UNITED STATES PATENT AND TRADEMARK OFFICE

CERTIFICATE OF CORRECTION

PATENT NO. : 6,278,234 B1
DATED : August 21, 2001
INVENTOR(S) : Takeo Ono et al.

It is certified that error appears in the above-identified patent and that said Letters Patent is hereby corrected as shown below:

Column 2,
Line 22, "on" should read -- one --.

Column 3,
Line 28, "view point" should read -- viewpoint --.

Column 5,
Line 13, "above identified" should read -- above-identified --; and
Line 53, "of" should read -- of an --.

Column 7,
Line 5, "to ward" should read -- toward --.

Column 8,
Line 67, "introduce" should read -- introducing --.

Column 9,
Line 4, "above described" should read -- above-described --; and
Line 24, "above described" should read -- above-described --.

Column 10,
Line 65, "above cited" should read -- above-cited --.

Column 11,
Line 36, "descrived" should read -- described --.

Column 12,
Line 22, "numeumeral" should read -- numeral --;
Line 24, "of" should read -- of an --; and
Line 63, "circuits" should read -- circuit --.

UNITED STATES PATENT AND TRADEMARK OFFICE

CERTIFICATE OF CORRECTION

PATENT NO. : 6,278,234 B1
DATED : August 21, 2001
INVENTOR(S) : Takeo Ono et al.

It is certified that error appears in the above-identified patent and that said Letters Patent is hereby corrected as shown below:

Column 15,
Line 3, "am" should read -- an --;
Line 37, "imageage-forming" should read -- image-forming --; and
Line 62, "denotes by" should read -- denoted by the --.

Column 16,
Line 67, "above listed" should read -- above-listed --.

Column 17,
Line 45, "envelope 5" should read -- envelope 5 -- (bold); and
Line 54, "an" should read -- a --.

Column 18,
Line 25, "an" should read -- a --.

Column 19,
Line 19, "arrives" should read -- arrives at --; and
Line 31, "shifts" should read -- shift --.

Column 20,
Line 39, "same" should read -- the same --.

Column 21,
Line 36, "same" should read -- the same --.

Column 23,
Line 3, "same" should read -- the same --; and
Line 37, "to simply the" should read -- to simplify the --.

Column 24,
Line 13, "different." should read -- different --; and
Line 36, "it" should read -- its --.

UNITED STATES PATENT AND TRADEMARK OFFICE

CERTIFICATE OF CORRECTION

PATENT NO. : 6,278,234 B1
DATED : August 21, 2001
INVENTOR(S) : Takeo Ono et al.

It is certified that error appears in the above-identified patent and that said Letters Patent is hereby corrected as shown below:

Column 25,
Line 28, "above." should read -- above --; and
Line 60, "device" should read -- devices --.

Column 26,
Line 44, "drive" should read -- driven --; and
Line 50, "operates" should read -- operate --.

Signed and Sealed this

Ninth Day of April, 2002

*Attest:*

*Attesting Officer*

JAMES E. ROGAN
*Director of the United States Patent and Trademark Office*